US007386901B2

(12) United States Patent
Dewert et al.

(10) Patent No.: US 7,386,901 B2
(45) Date of Patent: Jun. 17, 2008

(54) MODULAR SYSTEM FOR ASSEMBLING A MOTORIZED ADJUSTABLE SUPPORT APPARATUS FOR THE UPHOLSTERY OF FURNITURE FOR SITTING AND/OR LYING

(75) Inventors: Eckhart Dewert, Zürich (CH); Johannes Schneider, Kirchlengern (DE)

(73) Assignee: Cimosys AG, Zürich (CH)

( * ) Notice: Subject to any disclaimer, the term of this patent is extended or adjusted under 35 U.S.C. 154(b) by 179 days.

(21) Appl. No.: 11/293,494

(22) Filed: Dec. 5, 2005

(65) Prior Publication Data

US 2006/0130236 A1 Jun. 22, 2006

Related U.S. Application Data

(63) Continuation of application No. PCT/EP2004/005655, filed on May 26, 2004.

(30) Foreign Application Priority Data

Jun. 5, 2003 (DE) ..... 103 25 796
Apr. 1, 2004 (DE) ..... 10 2004 016 048

(51) Int. Cl.
*A61G 7/015* (2006.01)
*A61G 7/018* (2006.01)

(52) U.S. Cl. ..... 5/618; 5/616; 5/617; 5/620

(58) Field of Classification Search ..... 5/616–618, 5/620

See application file for complete search history.

(56) References Cited

U.S. PATENT DOCUMENTS 2,790,485 A 4/1957 Franklin
3,051,965 A 9/1962 Szemplak et al.

(Continued)

FOREIGN PATENT DOCUMENTS

CH 607 682 10/1978

(Continued)

OTHER PUBLICATIONS

PCT Schriftlicher Bescheid Der Internationalen Recherchenbehörde (Regel 43 bis. 1PCT) dated Jun. 5, 2003 (5 pages).

(Continued)

*Primary Examiner*—Michael Trettel
(74) *Attorney, Agent, or Firm*—Shlesinger, Arkwright & Garvey LLP

(57) ABSTRACT

Modular system for assembling a motorized adjustable support apparatus for the upholstery of a piece of furniture for one of sitting and lying includes a first support element including a first longitudinal rail assembly, and a second support element including a second longitudinal rail assembly. The first and second longitudinal rail assemblies are detachably connected by a connecting element to form a base of the support apparatus, in use. The assembled adjustable support apparatus includes the two support elements adjustable relative to one another for supporting the upholstery. A connecting shaft is provided for transmitting the rotation of a first pivot shaft connected to the first rail assembly to a third pivot shaft connected to the second rail assembly. Ends of the connecting shaft are detachably insertable into recesses defined in the first and third pivot shafts, and are securable against rotation.

61 Claims, 20 Drawing Sheets

U.S. PATENT DOCUMENTS

| | | | | |
|---|---|---|---|---|
| 3,300,794 | A | | 1/1967 | Altorfer |
| 3,447,170 | A | | 6/1969 | Spitz |
| 3,717,376 | A | | 2/1973 | Lutchansky |
| 3,868,103 | A | | 2/1975 | Pageot et al. |
| 4,120,057 | A | * | 10/1978 | Neumann ..... 5/616 |
| 4,258,445 | A | | 3/1981 | Zur |
| 4,336,621 | A | | 6/1982 | Schwartz |
| 4,349,924 | A | | 9/1982 | Zur |
| 4,381,571 | A | | 5/1983 | Elliott |
| 4,463,463 | A | | 8/1984 | Kaneko |
| 4,559,656 | A | | 12/1985 | Foster |
| 4,589,151 | A | | 5/1986 | Behrens |
| 4,800,599 | A | | 1/1989 | Korchinski et al. |
| 4,928,332 | A | | 5/1990 | Ogden et al. |
| 5,063,623 | A | | 11/1991 | Bathrick et al. |
| 5,317,769 | A | | 6/1994 | Weismiller et al. |
| 5,490,298 | A | | 2/1996 | Goldsmith et al. |
| 5,491,854 | A | | 2/1996 | Music |
| 5,537,701 | A | | 7/1996 | Elliott |
| 5,542,744 | A | | 8/1996 | Bathrick |
| 5,544,376 | A | | 8/1996 | Fromson |
| 5,577,280 | A | | 11/1996 | Elliott |
| 5,640,730 | A | | 6/1997 | Godettek |
| 5,675,849 | A | | 10/1997 | Koch |
| 5,687,437 | A | | 11/1997 | Goldsmith |
| 5,740,568 | A | * | 4/1998 | Elliott ..... 5/620 |
| 5,829,077 | A | | 11/1998 | Neige |
| 5,870,784 | A | | 2/1999 | Elliott |
| 5,916,086 | A | | 6/1999 | Rossdeutscher |
| 5,926,872 | A | | 7/1999 | Rossdeutscher |
| 5,926,877 | A | | 7/1999 | Lin |
| 6,006,379 | A | | 12/1999 | Hensley |
| 6,061,852 | A | | 5/2000 | Bathrick et al. |
| 6,079,065 | A | | 6/2000 | Luff et al. |
| 6,088,853 | A | | 7/2000 | Jansen et al. |
| 6,101,647 | A | | 8/2000 | Stroud et al. |
| 6,105,187 | A | | 8/2000 | Gnjatovic |
| 6,209,157 | B1 | | 4/2001 | Hensley |
| 6,269,707 | B1 | | 8/2001 | Koch |
| 6,311,348 | B1 | | 11/2001 | Luff |
| 6,357,065 | B1 | | 3/2002 | Adams |
| 6,393,641 | B1 | | 5/2002 | Hensley |
| 6,679,555 | B2 | | 1/2004 | Bangert |
| 6,687,932 | B1 | | 2/2004 | Bangert et al. |
| 6,742,205 | B2 | | 6/2004 | Dewert |
| 6,754,922 | B2 | | 6/2004 | Dewert |
| 6,763,536 | B2 | | 7/2004 | Dewert |
| 6,990,698 | B2 | * | 1/2006 | Wall, Sr. ..... 5/618 |
| 2001/0000828 | A1 | | 5/2001 | Hensley |
| 2002/0152552 | A1 | | 10/2002 | Dewert |
| 2002/0162170 | A1 | | 11/2002 | Dewert |
| 2003/0052238 | A1 | | 3/2003 | Schneider |
| 2003/0079290 | A1 | | 5/2003 | Dewert |
| 2003/0106154 | A1 | | 6/2003 | Takeuchi |
| 2003/0208845 | A1 | | 11/2003 | Heaton |
| 2004/0034934 | A1 | | 2/2004 | Weinman et al. |

FOREIGN PATENT DOCUMENTS

| | | | |
|---|---|---|---|
| DE | 26 14 105 | A | 10/1976 |
| DE | 31 03922 | A1 | 8/1982 |
| DE | 32 182 78 | A1 | 11/1983 |
| DE | 32 16559 | A1 | 11/1983 |
| DE | 87 11 567 | U1 | 3/1988 |
| DE | 88 00 360 | U1 | 7/1988 |
| DE | 88 06 094.2 | | 8/1988 |
| DE | 38 42 978 | A1 | 7/1989 |
| DE | 91 10 121 | U | 11/1991 |
| DE | 38 42 078 | C1 | 7/1992 |
| DE | G 92 10 801.6 | | 12/1992 |
| DE | 93 11 520 | U1 | 6/1994 |
| DE | 195 00 185 | A1 | 7/1996 |
| DE | 195 03 650 | A1 | 8/1996 |
| DE | 195 43 321 | A1 | 5/1997 |
| DE | 297 01 084 | | 7/1997 |
| DE | 298 00 197 | U1 | 4/1998 |
| DE | 197 39 453 | A1 | 3/1999 |
| DE | 695 07 158 | T2 | 9/1999 |
| DE | 299 19 238 | U1 | 4/2000 |
| DE | 200 00 700 | U1 | 5/2000 |
| DE | 299 07 850 | U1 | 5/2000 |
| DE | 199 21 300 | A1 | 11/2000 |
| DE | 201 00 733 | U1 | 4/2001 |
| DE | 100 17 979 | A1 | 7/2001 |
| DE | 100 46 751 | A1 | 7/2001 |
| DE | 199 62 541 | A1 | 7/2001 |
| DE | 199 62 538 | A1 | 8/2001 |
| DE | 100 17 978 | C2 | 10/2001 |
| DE | 100 46 752 | | 3/2002 |
| DE | 100 46 750 | C1 | 4/2002 |
| DE | 203 02 139 | U1 | 5/2003 |
| DE | 199 62 541 | C3 | 11/2003 |
| EP | 0 373 912 | | 6/1990 |
| EP | 372 032 | B1 | 6/1990 |
| EP | 0 568 957 | | 11/1993 |
| EP | 0 583 660 | A1 | 2/1994 |
| EP | 0 445 325 | B1 | 6/1994 |
| EP | 0 642 753 | A1 | 3/1995 |
| EP | 0 721 754 | | 7/1996 |
| EP | 0 778 016 | A2 | 6/1997 |
| EP | 0 873 709 | A1 | 10/1998 |
| EP | 0 884 0121 | A1 | 12/1998 |
| EP | 0 788 325 | B1 | 1/1999 |
| EP | 0 935 937 | | 8/1999 |
| EP | 0 935 937 | A1 | 8/1999 |
| EP | 1 152 167 | A2 | 11/2001 |
| EP | 0 372 032 | B2 | 3/2002 |
| FR | 761 361 | A | 3/1934 |
| FR | 2 780 256 | A1 | 12/1999 |
| GB | 2 081 083 | A | 2/1982 |
| WO | 91/01099 | | 2/1991 |
| WO | 92/09520 | | 6/1992 |
| WO | 96/29970 | | 10/1996 |
| WO | 99/42021 | | 8/1999 |
| WO | 2004/062435 | A1 | 7/2004 |

OTHER PUBLICATIONS

International Search Report dated Oct. 19, 2004 in PCT/EP2004/005655, filed May 26, 2004 (2 pages).

Catalogue of the German firm Dewert Antriebs- und Systemtechnik "Gesamtprogramm 1995/96" pp. 12 & 13.

Catalogue of the German firm Dewert Antriebs-und Systemtechnik "Antriebe, Handschalter, Steuerungen, Beschläge", No. 05/97 (excerpt 6 pages).

* cited by examiner

MODULAR SYSTEM FOR ASSEMBLING A MOTORIZED ADJUSTABLE SUPPORT APPARATUS FOR THE UPHOLSTERY OF FURNITURE FOR SITTING AND/OR LYING

CROSS-REFERENCE TO RELATED APPLICATION

This application is a continuation of application no. PCT/EP2004/005655, filed May 26, 2004, and this application claims the priority of German application no. 103 25 796.9, filed Jun. 5, 2003, and this application claims the priority of German application no. 10 2004 016 048.1, filed Apr. 1, 2004, and each of which is incorporated herein by reference.

This application relates to applicant's concurrently filed application no. [applicant's ref. 7466], entitled "Motorized Adjustable Support Apparatus for the Upholstery of Furniture for Lying or Sitting, in Particular A Bed Mattress".

FIELD OF THE INVENTION

The invention relates to a modular system for assembling a motorized adjustable support apparatus for the upholstery of furniture for sitting and/or lying.

BACKGROUND OF THE INVENTION

Support apparatuses for the upholstery of furniture for sitting and/or lying are commonly known in the form of slatted frames. The slatted frames of the prior art feature a base, which features a plurality of support elements, which can be adjusted relative to one another and on which the a bed mattress is supported when the slatted frame is employed. The support elements can be pivoted relative to one another about substantially parallel pivoting axes. For example, the slatted frame can feature a fixed center support, to the end of which an upper body support is connected hingedly and pivotally about a horizontal pivot axle, wherein a leg support can be connected hingedly and pivotally about a horizontal axle to the end of the center support facing away from the upper body support, so that this known slatted frame comprises three support elements arranged tandemly lengthwise in the slatted frame.

Slatted frames with five or more support elements are also known from the prior art, wherein a head support is usually connected hingedly and pivotally about a horizontal pivot axle to the end of the upper body support facing away from the center support, while the calf support is connected hingedly and pivotally about a horizontal pivot axle to the end of the leg support facing away from the center support.

In the slatted frames of the prior art the supports connected hingedly to one another are designed so that the longitudinal rails of the slatted frame feature a plurality of sections in tandem, wherein two sections immediately tandem to one another are hingedly connected to one another and the corresponding sections of both longitudinal rails form with one another, or optionally together with at least a transverse rail connecting these sections, a support element. On their upper surfaces, the support elements feature suspension elements, for example, flexible slats. In the support apparatuses of the prior art the corresponding sections of the longitudinal rails are, as a rule, permanently connected to one another, for example, by being glued to a transverse rail. As a result a nondestructive disassembly of the prior art slatted frame is not possible.

Slatted frames are also known in the prior art, in which the transverse rails are connected to the longitudinal rails by fasteners. In these slatted frames of the prior art, a nondestructive disassembly is also not possible.

To facilitate the motorized adjustment of the slatted frames of the prior art, drives in the form of so-called double drives are known, wherein two drive mechanisms are present in the same housing. A double drive of this type is known, for example, from EP 0 372 032 B2.

From DE 38 42 078 C2 a motorized adjustable support apparatus in the form of a slatted frame is known, which for electromechanical adjustment features a double drive, which is disposed below a fixed center support. For adjusting an upper body support relative to the center support a yolk is present, which is connected nonrotatably to a shaft mounted pivotally on the understructure of the slatted frame and on which the upper body support rests closely. In a corresponding manner a lever assembly is present for pivoting a leg support and calf support connected thereto, which is connected nonrotatably with another shaft mounted on the understructure of the slatted frame. The pivoting of the shaft is facilitated by means of the drive mechanisms of the double drive. In the slatted frame of the prior art the double drive can be housed in the actual slatted frame.

From DE 199 62 541 C3 a motorized adjustable support apparatus in the form of a slatted frame is known, in which at least one of the longitudinal rails one of the supports is realized as a hollow section, wherein an electromechanical drive for adjusting the supports relative to one another is housed in the hollow section. In this slatted frame of the known art, the longitudinal rails are fixedly connected to one another via transverse rails.

Furthermore, the width of the slatted frame of the prior art is strictly dictated by the fixtures employed via which the electromechanical drive actuates the support elements to be adjusted and cannot be modified.

A similar support apparatus is also known from DE 100 46 751 A1.

OBJECTS AND SUMMARY OF THE INVENTION

An object of the invention is to overcome the drawbacks of the prior art.

Another object of the invention is to facilitate a simpler and therefore more economical manufacturing process for the motorized adjustable support device.

This object is solved through the features of the inventive motorized adjustable support apparatuses for upholstery of furniture, as set forth below.

A basic idea of the invention is to manufacture motorized adjustable support apparatuses for upholstery of furniture for sitting and/or lying, in particular slatted frames, using a modular system, the components of which can be used for assembling different support apparatuses. The fundamental components of the inventive modular system include a first longitudinal rail assembly, and at least a second longitudinal rail assembly, as well as connecting element, which serves to keep the first longitudinal rail assembly and second longitudinal rail assembly spaced laterally apart from one another and detachably connected in such a manner that, particularly when the same longitudinal rail assemblies are employed, support apparatuses of different widths can be assembled by employing connecting element(s) defining different lateral spacing between the longitudinal rail assemblies.

According to the invention, support apparatuses of various widths can be constructed using the same longitudinal assemblies by employing connecting element(s) of different widths. In this manner, the assembly of the motorized adjustable support apparatus is significantly simplified and rationalized and is therefore more economical.

Owing to the detachable connection of the longitudinal rail assemblies with one another via the connection element(s) it is possible according to the invention to transport the support device, for example a slatted frame, disassembled as its individual parts. Significant savings in space during transportation are thus achieved over conventional support apparatuses, which are shipped, assembled. Owing to the detachable connection(s) of the components of the support device, the assembly of the support apparatus can also be performed by an end customer.

Owing to the inventive modular system, storage during the manufacture of the motorized adjustable support apparatuses is significantly simplified.

An exceptionally advantageous improvement of the invention provides that at least one of the longitudinal rail assemblies is provided as a housing to contain at least portions of a drive mechanism and/or an output mechanism. In this embodiment a drive element, which in the assembled state of the support apparatus serves to adjust the support elements of the support apparatus relative to one another, can, for example, be integrated at least partly into a longitudinal rail assembly. In this manner a separate housing for the drive mechanisms and/or output mechanism is not necessary, so that the number of required parts for the assembly of the motorized adjustable support apparatus is reduced. This simplifies the assembly.

An improvement of the embodiment mentioned above provides at least one of the longitudinal rail assemblies is preferably realized as a closed hollow section or one that is open on one side. Hollow sections of this type made of synthetic material are especially economical.

It is advantageous if the drive mechanism has at least a drive motor, for example, an electric motor.

An improvement of the embodiment with the longitudinal rail assembly realized as a housing, provides that the drive mechanism, including at least the electric motor, is contained in the housing. In this embodiment the drive mechanism is housed completely in the longitudinal rail assembly. It is therefore not externally visible and is furthermore protected from dirt and damage.

Another improvement of the invention provides that the drive motor or at least an end of the drive motor facing the output shaft is disposed outside the housing, a recess is present in one of the side walls of the first longitudinal rail assembly opposite the second longitudinal rail assembly and the drive motor is in a driven connection through the recess with parts of the drive mechanism it with present in the interior of the first longitudinal rail assembly.

In this embodiment the drive motor is disposed outside the longitudinal rail assembly. In this manner the spatial freedom in the selection of gear arrangement is increased over that of an embodiment in which all components of the drive mechanism are housed in the hollow longitudinal rail. Owing particularly to the invention, a simple and therefore economical gear assembly can be employed, facilitating an especially simple and therefore economical manufacturing process for the inventive chair.

In an advantageous improvement of the embodiment described above, the output shaft of the drive motor or an end of the drive motor bearing the output shaft of the drive motor or a first gear element in a driven connection with the output shaft of the drive motor projects through the recess and into the interior of the first longitudinal rail assembly, wherein in the assembled state of the support apparatus the first gear element engages a second gear element present in the interior of the first longitudinal rail assembly. In this embodiment in particular, an especially simple and economical construction is realized if the gear assembly includes only two gear elements.

Another advantageous improvement of the invention provides that the drive motor is disposed almost completely outside the first longitudinal rail assembly. In this embodiment only the output shaft of the drive motor or the first gear element in a driven connection with the output shaft projects into the interior of the first longitudinal rail assembly.

In an advantageous improvement of the embodiment described above, the first drive element is a worm gear of a worm gear assembly, a worm wheel of which is disposed in the interior of the first longitudinal rail assembly and constitutes the second drive element.

Worm gear assemblies of this type are available as simple and economical standard assemblies. They facilitate an especially high degree of transmission and are especially robust.

In the embodiment described above additional gear elements can be disposed in principle between the output shaft of the drive motor and the worm gear, via which the worm gear can be in a rotationally driven connection with the output shaft. To further simplify and thereby reduce the cost of construction, it is advantageous if the worm gear is attached nonrotatably to the drive motor, for example, formed onto the output shaft of the drive motor.

In principle, it is possible, that in side view the drive motor projects above or beneath the respective longitudinal rail assembly. To achieve an especially low construction height, it is advantageous if in side view the drive motor lies substantially within the profile height of the respective longitudinal rail assembly, in such a manner that the drive motor is disposed in or on the first longitudinal rail assembly without projecting above it.

In this embodiment an especially low construction height is achieved, which is determined by the profile height of the longitudinal rail assembly.

In principle the drive motor can be disposed on a side of one longitudinal rail assembly opposite the other longitudinal assembly. In an advantageous improvement, the drive motor is disposed at the side of the respective longitudinal rail assembly opposite the other longitudinal rail assembly, in such a manner that the drive motor is disposed between the longitudinal rail assemblies. In this embodiment, the drive motor is concealed by the longitudinal rail assemblies in side view and is therefore barely visible.

In principle the transmission of the drive force of the drive motor to the support elements for the adjustment thereof can be facilitated in a suitable manner according to user preference. An especially advantageous improvement of the invention provides that in or on at least one of the longitudinal rail assemblies a pivot shaft is mounted pivotally, which forms a drive element of the drive mechanism and in the assembled state of the support apparatus is in a driven connection with at least one of the adjustable support elements of the support device. This embodiment facilitates an especially simple and robust construction.

An advantageous improvement of the embodiment described above provides that, mounted in or on at least one of the longitudinal rail assemblies are at least two pivot shafts, which in the assembled state of the support apparatus are provided on different support elements for the adjustment thereof. In this embodiment, the pivot shafts are in a driven connection with different support elements, so that, if an independent control of the pivot shafts is provided, the individual support elements can be adjusted independently of one another.

In the embodiments described above each pivot shaft is advantageously in an actuating connection with its attached support element via a lever assembly when the support apparatus is in assembled state.

The lever assembly can include a single, in particular a single-armed lever, or a combination of multiple levers.

To achieve an especially simple and thereby economical construction, an improvement of the embodiment described above provides that the lever assembly features at least a pivot lever, which is connected nonrotatably to the respective pivot shaft.

In the embodiment described above, the pivot lever can be detachably connected to the respective pivot shaft. To further simplify the construction and make it especially robust, an advantageous improvement provides that the pivot lever is fixedly connected to the attached pivot shaft, for example, welded to the pivot shaft. In this embodiment the pivot lever is already joined to the pivot shaft by the manufacturer, so that the assembly of an inventive support apparatus using the inventive modular system is further simplified. An advantageous improvement of the embodiment with the pivot lever provides that a lever extension can be connected loosely, yet preferably nonpivotably, to at least one of the pivot levers. In this embodiment, the length of the lever arm of the pivot lever can be freely selected according to a desired lever extension. This allows the particular support apparatus being assembled from the modular system to be adapted to the particular load situation in an especially simple and flexible manner.

To make the mounting of the lever extension to the respective pivot lever especially simple, the lever extension can be clipped onto the respective pivot lever.

In principle a pivoting of a support element by means of the pivot lever can be realized with the support resting loosely on the pivot lever, so that it is pivoted when the pivot lever is pivoted. An especially advantageous improvement of the invention provides that the lever assembly, for example, the pivot lever, forms a part of the longitudinal rail. In this embodiment the construction is further simplified, as the pivot lever itself forms a portion of the longitudinal rail and thereby allows a separate component in the form of an additional pivot lever to be omitted.

In the embodiment, in which at least one of the longitudinal rail assemblies is realized as a housing to contain at least portions of a drive mechanism and/or output mechanism it is possible in principle that each of the longitudinal rail assemblies has at least one drive mechanism attached thereto. For example, identical drive mechanisms can be disposed in the longitudinal rail assemblies so that the power from the drive mechanisms is conducted to the supports symmetrically on a longitudinal center plane of the support device, for example, if the support apparatus to be assembled is especially wide, as in the case of a slatted frame for a double bed, it is advantageous if each of the longitudinal rail assemblies or, if more than two longitudinal rail assemblies are present, at least two of the longitudinal rail assemblies each have an attached drive mechanism. In an advantageous improvement of the invention, transmission element are provided for transmitting a rotation of a first pivot axle present in the first longitudinal rail assembly to a third pivot shaft present in the second longitudinal rail assembly as well as for transmitting a rotation of a second pivot shaft present in the first longitudinal rail assembly to a fourth pivot shaft present in the second longitudinal rail assembly. In this embodiment, for example, only the first longitudinal rail assembly can be provided with at least one drive mechanism, which rotationally drives the first and/or the second pivot shaft, while the third and the fourth pivot shafts, which are connected to the second longitudinal rail assembly can be pulled and rotationally driven by the first and second pivot shafts, respectively, via the transmission element. In this embodiment, a drive mechanism provided on the second longitudinal rail assembly is not required. Nevertheless an substantially symmetrical conduction of power on the longitudinal plane of the support apparatus is thereby ensured with the third and the fourth pivot shaft being pulled by the first and second pivot shaft, respectively. If in both or, if more than two longitudinal rail assemblies are present, in at least two longitudinal rail assemblies at least one drive mechanism is attached, the transmission element can nevertheless be provided to facilitate a mechanically forced coupling of the first pivot shaft to the third pivot shaft as well as the second pivot shaft to the fourth pivot shaft. In this manner a distortion of the support is prevented should an asynchronous control of two drive mechanisms connected to the same support occur.

In improvements of the embodiments described above, the first and third pivot shafts are provided on the same support to be adjusted in the assembled state of the support apparatus and/or the second and fourth pivot shafts are provided on the same support to be adjusted in the assembled state of the support device.

In the embodiments with transmission element the transmission element can in principle be realized in a suitable manner according to preference. For example, the transmission element can feature gear elements, which transmit the rotation of the first and third pivot axles to the second and fourth pivot axles, respectively. To further simplify the construction, an advantageous improvement has the transmission element connecting the first and third pivot axle and/or the second and fourth pivot axle in essence nonrotatably to one another.

An improvement of the embodiment described above provides that the transmission element for creating an substantially nonrotatable connection between two pivot shafts feature at least a connecting shaft. In this embodiment the construction is especially simple and therefore economical, as the transmission of the rotation of a pivot shaft provided on the first longitudinal rail assembly to the corresponding pivot shaft provided on the second longitudinal rail occurs via a simple connecting shaft.

In principle the connecting shaft can be connected to the respective pivot shaft in a manner according to preference.

Advantageously, the connecting shaft can be connected detachably, that is, without permanent fasteners, to the attached pivot shafts in a manner according to preference. In an exceptionally advantageous improvement, the connecting shaft can be connected to the pivot shafts nonrotatably circumferentially, while loosely axially. In this embodiment the mounting of the connecting shafts onto the pivot shafts is especially simple, as the nonrotatable connection is created without permanent fasteners.

An especially advantageous improvement of the embodiment described above provides that the pivot shafts to be connected each features an axial recess with an noncircular cross section and the axial ends of the connecting shaft each feature a cross section substantially complementary to the respective recess, so that the ends of the connecting shafts exhibit an substantially form-fitting engagement with the recesses in the pivot shafts. In this embodiment the mounting of the connecting shafts onto the pivot shafts is especially simple. A special advantage of this embodiment is found in the fact that to realize different support apparatus widths, it is only necessary to trim the connecting shaft according to the desired length, for example, the connecting shaft can be made of a squared material, for example, a squared pipe or a squared rod, which is trimmed according to the desired width of the particular support device.

Another exceptionally advantageous improvement of the embodiments with the connecting shafts provides that the ends of the connecting shafts can be inserted loosely into the recesses in the pivot shafts. In this embodiment an especially simple mounting of the pivot shafts is achieved, as it is only necessary to insert the pivot shaft loosely into the respective recesses in the pivot shafts.

In principle the recesses in the pivot shafts can be realized, for example, as blind holes. If the recesses in the pivot shafts are realized as continuous recesses, then it is advantageous if stopping element are present to limit the axial insertion depth of the ends of the connecting shaft into the recesses of the pivot shafts. In this embodiment it is ensured that, following the mounting of the connecting shafts, the longitudinal rail assemblies connected to one another via the connecting shaft or the connecting shafts are spaced at a preset distance from one another determined by the length of the particular connecting shaft or connecting shafts.

In the embodiment described above the stopping element can be realized in a suitable manner according to preference. In an especially simple and economical improvement, the stopping element is formed at least partly by an outer frame of the support apparatus in the assembled state of the support device. In this embodiment additional stopping element are not required. The outer frame of the support apparatus can be formed, for example, by two wooden rails set parallel and apart from one another in assembled state, wherein on each of the rails one of the longitudinal rail assemblies is secured.

In the embodiments described above a stop is advantageously provided on each of the pivot shafts to be connected substantially nonrotatably to one another via a connecting shaft.

In the embodiments with the lever assembly the particular longitudinal rail can be formed in principle by the lever assembly or a part of the lever assembly, so that the supports are at least formed partly by the lever assembly itself. In this embodiment suspension elements, for example, flexible slats, are then carried directly by portions of the lever assembly. To give the inventive support apparatus to be assembled from the inventive modular system a more favorable visual appearance, an advantageous improvement provides that at least one of the lever assemblies can be concealed with a casing, the upper surface of which forms the upper surface of the respective longitudinal rail in the assembled state of the support device. In this embodiment the inventive support apparatus is visually appealing.

An advantageous improvement of the embodiment described above provides that the casing is detachably connected to the lever assembly, for example, can be snapped thereon. In this embodiment the mounting of the casing onto the lever assembly is simplified.

Another improvement of the invention provides that each longitudinal rail is formed lengthwise in the support apparatus at least in sections by the respective longitudinal rail assembly in the assembled state of the support device. In this embodiment an especially simple construction with few components is achieved.

Another improvement of the invention provides that each longitudinal rail assembly is formed lengthwise in the support apparatus at least in sections by the pivot shaft as well as a casing of the pivot shaft in the assembled state of the support device.

Another improvement provides that the longitudinal rail assembly is formed lengthwise in the support apparatus at least in sections by profile elements, for example, hollow profile elements or profile elements open on one side in the assembled state of the support device.

According to the invention, it is therefore possible to form the longitudinal rail lengthwise in the support apparatus through the respective longitudinal rail assembly and/or a portion of the lever assembly as well as the casing thereof and/or through a profile element. Within the scope of the invention, a longitudinal rail is understood as a weight-bearing component extending lengthwise in the respective support apparatus and which, in an assembled position of the support apparatus, assumes pressure forces and directly or indirectly bears the suspension elements, for example, flexible slats or the like, provided for supporting upholstery.

An improvement of the embodiment with casing provides that the casing of the lever assembly is formed, at least in sections, by profile elements, for example, hollow profile elements or profile elements open on one side in the assembled state of the support device. In this embodiment an especially simple construction is achieved.

To simplify the mounting of the profile elements onto the lever assembly, an advantageous improvement of the embodiments with the profile elements provides that these an substantially U-shaped cross section, which, in the assembled state of the support device, opens on the bottom. In this embodiment the profile elements can be slid or clipped onto the respective parts of the lever assembly from above in an especially simple manner.

In the embodiments listed above the profile elements are advantageously made of synthetic material.

The cost of manufacturing the profile elements thus is kept low.

Another advantageous improvement of the invention provides that on the upper surface of the respective longitudinal rail retaining element for retaining suspension elements, for example, flexible slats can be detachably connected. An advantage of this embodiment resides in the fact that the retaining elements can be realized as separate components, which are first connected to the respective longitudinal rail during the assembly of the support device. In this manner the construction of the inventive support apparatus is still realized as modular according to the basic idea of a modular system.

In principle the retaining elements can be fixedly connected to the suspension elements. To make the construction even more modular, it is advantageous if the retaining elements detachably retain the suspension elements.

An exceptionally advantageous improvement of the embodiment with the transmission element provides the connecting elements are at least partly, preferably substantially completely, formed by the transmission element. If the transmission device is formed, for example, by a pivot shaft or multiple pivot shafts, these pivot shafts, for example, can form at the same time the connecting element for connecting the longitudinal rail assemblies to one another, so that additional connecting element(s) are not required. In this manner an especially simple construction with few components is achieved.

Other improvements of the invention provide that the support apparatus features in assembled state a fixed center support and at least an additional support adjustable relative to the center support and/or that the longitudinal rail assemblies form portions of the center support.

Within the scope of the invention a support is understood as a component of an inventive support device absorbing the resulting pressure forces when upholstery is supported, which, for example, bears the suspension elements, on which the upholstery is supported when the support apparatus is used.

The embodiment described above allows, for example, the support apparatus to be realized in assembled state without a transverse rail in its center support, as is found in another improvement. Within the scope of the invention, a transverse rail is understood as rail connecting the longitudinal rails, which absorb the resulting pressure forces when upholstery is supported, of the support element to one another. By eliminating a transverse rail of this type from the center support, the construction of the inventive support apparatus is further simplified.

For example, the assembly of the support apparatuses is also simplified thanks to the inventive modular system.

According to the invention the longitudinal rail assemblies used in the modular system are realized as separate components.

A support apparatus that can be assembled from the inventive modular system is as set forth herein. Advantageous and practical improvements of the inventive support apparatus are as set forth herein.

A longitudinal rail assembly usable in an inventive modular system as set forth herein. Advantageous and practical improvements of the inventive longitudinal assembly as set forth herein.

The invention is explained in further detail below in conjunction with the attached drawings, in which an embodiment of an inventive modular system and an inventive support apparatus in the form of a slatted frame are illustrated. All features described or illustrated in the drawing thereby constitute on their own or in any given combination the object of the invention, independent of their summary in the patent claims or the retraction thereof as well as independent of their formulation or illustration in the description or drawing, respectively.

DETAILED DESCRIPTION OF THE INVENTION

Figure 1:
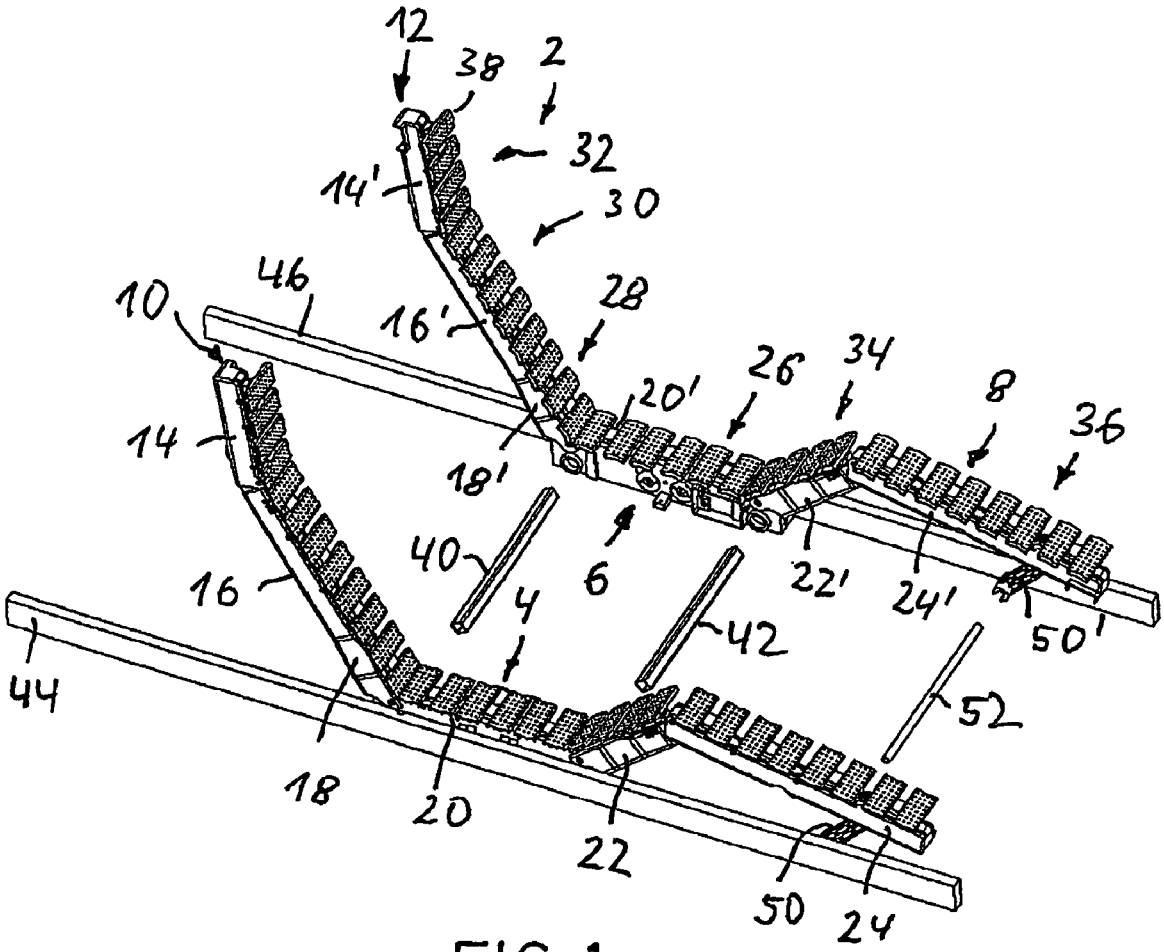
FIG. 1 is an exploding illustration of components of an inventive modular system.

In FIG. 1 components of an inventive modular system for assembling a motorized adjustable support apparatus for the upholstery of furniture for sitting or lying are illustrated. In this embodiment the inventive modular system is employed in the assembly of slatted frames, of which a slatted frame 2 is illustrated in FIG. 1 as an example.

The inventive modular system features a first longitudinal rail assembly 4 and a second longitudinal assembly 6, which are realized as separate components and can be spaced apart laterally and connected detachably to one another via connecting element in a manner described in further detail below to form a base 8 of the slatted frame 2 and can be nondestructively disassembled.

The base 8 of the slatted frame 2 features two longitudinal rail assemblies 10, 12 parallel to one another. The longitudinal rail 10 features a first longitudinal rail segment 14, a second longitudinal rail segment 16, a third longitudinal rail segment 18, a fourth longitudinal rail segment 20, a fifth longitudinal rail segment 22 and a sixth longitudinal rail segment 24 in tandem arrangement running lengthwise in slatted frame 2.

The first longitudinal rail segment 14 is connected hingedly and pivotally about a horizontal pivot axle to an end of the second longitudinal rail segment 16, the other end of which is connected fixedly to the third longitudinal rail segment 18. The end of the third longitudinal rail segment 18 facing away from the second longitudinal rail segment 16 is connected hingedly and pivotally about a horizontal pivot axle to a fourth longitudinal rail segment 20, which is fixed into position and in this embodiment is formed by the first longitudinal rail assembly 4. The end of the fourth longitudinal rail segment 20 facing away form the third longitudinal rail segment 18 is connected hingedly and pivotally about a horizontal pivot axle to an end of the fifth longitudinal rail segment 22, the end of which facing away from the fourth longitudinal rail segment is connected hingedly and pivotally about a horizontal pivot axle to the sixth longitudinal rail segment 24. The second longitudinal rail 12 features corresponding longitudinal rail segments 14', 16', 18', 20', 22', 24'.

In the assembled state of the slatted frame 2 the longitudinal rail segments 20, 20' together form a fixed center support element 26, the longitudinal rail segments 18, 18' together form a lumbar support 28, the longitudinal rail segments 16, 16' together form an upper body support element 30 and the longitudinal rail segments 14, 14' form a head support 32.

Furthermore, when the slatted frame 2 is in the assembled state, the longitudinal rail segments 22, 22' together form a leg support 34, while the longitudinal rail segments 24, 24' together form a calf support 36.

In the embodiment shown in FIG. 1, the thus formed support elements 26-26 feature on the side facing their support surfaces, on which, when the slatted frame 2 is used, upholstery, for example a mattress, rests on support elements 26-36. That is, their upper surface and therefore the upper surface of the longitudinal rails 10, 12, retaining elements for retaining suspension elements, of which only one retaining element is labeled 38 in FIG. 1. In this embodiment, the retaining elements serve to facilitate the detachable retention of flexible slats not shown in FIG. 1.

The connecting elements provided according to the invention, which constitute an essential component of the inventive modular system and of the inventive slatted frame 2, are realized in this embodiment as connecting shafts 40, 42, the function of which is explained in further detail below. In this embodiment, the connecting shafts 40, 42 are realized as tubes of noncircular cross section, namely one of substantially squared outer cross section.

The slatted frame 2 also features an outer frame, which in this embodiment features two rails 44, 46 offset from and running parallel to one another in an assembled state, which can be set onto a bedstead for positioning the slatted frame 2 on a bed not illustrated in the drawing. In the assembled state of the slatted frame 2, the first longitudinal rail assembly 4 is detachably connected to the rail 44, while the second longitudinal rail assembly 6 is detachably connected to the rail 46. The longitudinal rail assemblies 4, 6 can, for example, be screwed to the rails 44 and 46, respectively.

The sixth longitudinal rail section 24 is hingedly connected at its free end to the rail 44 via an arm 50, while the longitudinal rail section 24' is hingedly connected in the corresponding manner to the rail 46 via an arm 50'. An axle 52 is provided for pivotally mounting the arm 50, 50'.

Figure 2:
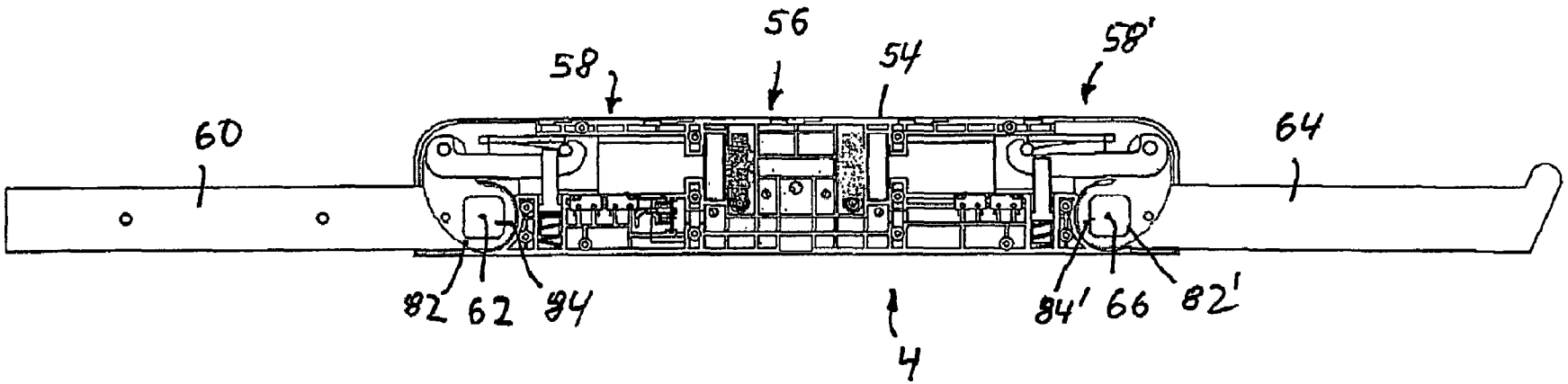
FIG. 2 is a longitudinal section through a first longitudinal rail assembly of the modular system as shown in FIG. 1.

In FIG. 2 the first longitudinal rail assembly 4 is illustrated, which in this embodiment is a closed hollow section and is realized as a housing 54 to contain parts of a drive mechanism 56. In this embodiment, the drive mechanism features two drive units 58, 58', which are both contained in the housing 54 and thereby constitute a double drive. In a manner explained in further detail below with reference drawn to FIG. 3, drive unit 58 serves to pivot a pivot lever 60 about a first, in this embodiment, a horizontal, pivot axle 62, while the drive unit 58' serves to pivot a pivot lever 64 about a second pivot axle 66 parallel to the first pivot axle 62.

Figure 3:
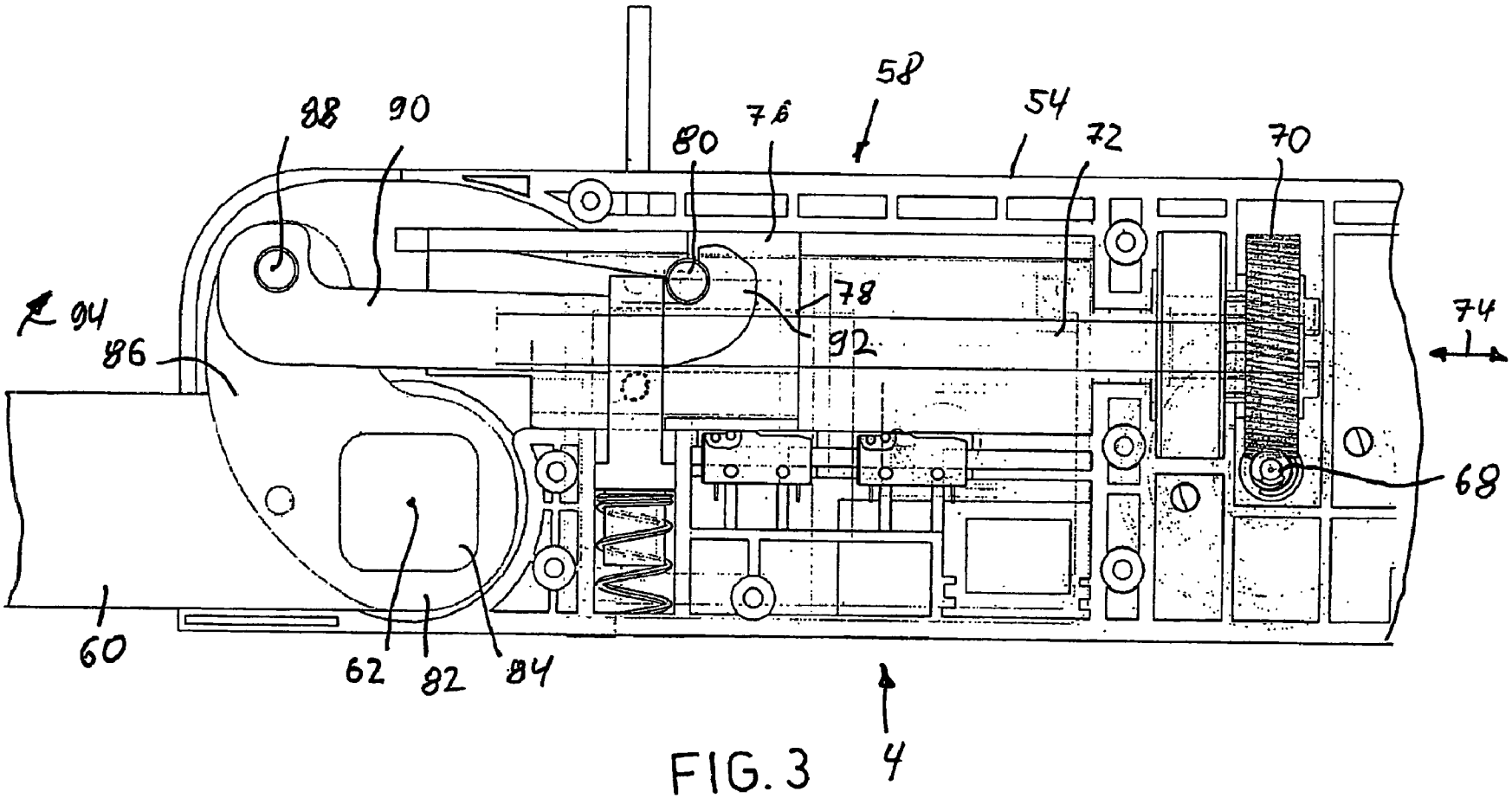
FIG. 3 is a portion of the first longitudinal rail assembly as shown in FIG. 2 in the same view as FIG. 2 yet on a larger scale than in FIG. 2.

FIG. 3 is drawing of the drive unit 58 shown in FIG. 2, on a larger scale, which is described in further detail below. The drive unit 58' features a corresponding construction and is therefore not described in further detail.

The drive unit 58 features an electric motor, not shown, as the drive motor, the output shaft of which is realized as a worm gear 68 and engages a worm wheel 70 mounted rotatably inside the housing 54, thereby forming a worm gear assembly. Connected nonrotatably to the worm wheel 70 is a threaded spindle 72, which is mounted rotatably in the housing 54 and on which a spindle nut 76 is provided nonrotatably and movable along the axis of the threaded spindle 72 in the direction of a double arrow 74. In this embodiment, the spindle nut 76 constitutes a drive element of the drive unit 58, the former of which moves linearly along a linear motion axis overlapping the longitudinal axis of the threaded spindle 72.

In this embodiment the spindle nut 76 is realized as a component made of synthetic material and is screwed onto the outer threading of the threaded spindle 72 with an inner threading 78. The spindle nut 76 also features a stud 80 running perpendicular to the threaded spindle 72.

Mounted in the housing 54 pivotally about a first pivot axle 62 is a first pivot shaft 82, which in this embodiment is realized as a shaft stud. The first pivot shaft 82 features a recess 84 running in axial relation to the first pivot axle 62, penetrating through the pivot shaft and, in this embodiment, featuring an substantially square cross section. The substantially square cross section of the recess 84 is realized as substantially complementary to the outer cross section of the connecting shaft 40 (see FIG. 1).

The pivot lever 60 is connected nonrotatably to the pivot shaft 82, wherein the nonrotatable connection in this embodiment is realized through welding.

Nonrotatably connected to the pivot shaft 82 is a single-armed lever 86, connected to which is an end of a rod 90, which is connected eccentrically to the first pivot axle 62 and hingedly and pivotally about a third pivot axle 88 parallel to the second pivot, and the end of which facing away from the pivot axle 88 is realized as a hook 92 and hooks formfitting around the stud 80 formed on the spindle nut 76.

To facilitate an emergency lowering of the slatted frame 2 in the event, for example, of a power outage, the hook 92 can be unhooked from the stud in a manner described in further detail below with reference drawn to FIGS. 15A to 15F.

To pivot the lever 60 in FIG. 3 clockwise in the direction of the arrow 94, the electric motor drives the threaded spindle 72 in such a manner, that the spindle nut 76 moves to the right in FIG. 3. Via the hook 92 the rod 90 is hereby in an engaging connection with the spindle nut 76, so that the rod 90 is taken to the right in FIG. 3. The lever 86 and thereby the pivot shaft 82 and the pivot lever 60 connected nonrotatably to the pivot shaft 82 are hereby pivoted in the direction of the arrow 94.

A pivoting of the lever 16 about the pivot axle 62 in FIG. 3 in counterclockwise direction, that is, against the direction of the arrow 94, occurs when the power is switched on, yet also under the weight of the support element connected to the lever 60 as well as under the weight of a person resting on this support element, as is described in further detail below.

The assembly of the inventive slatted frame 2 using the inventive modular system is explained in further detail below in conjunction with FIGS. 4 through 9.

Figure 4:
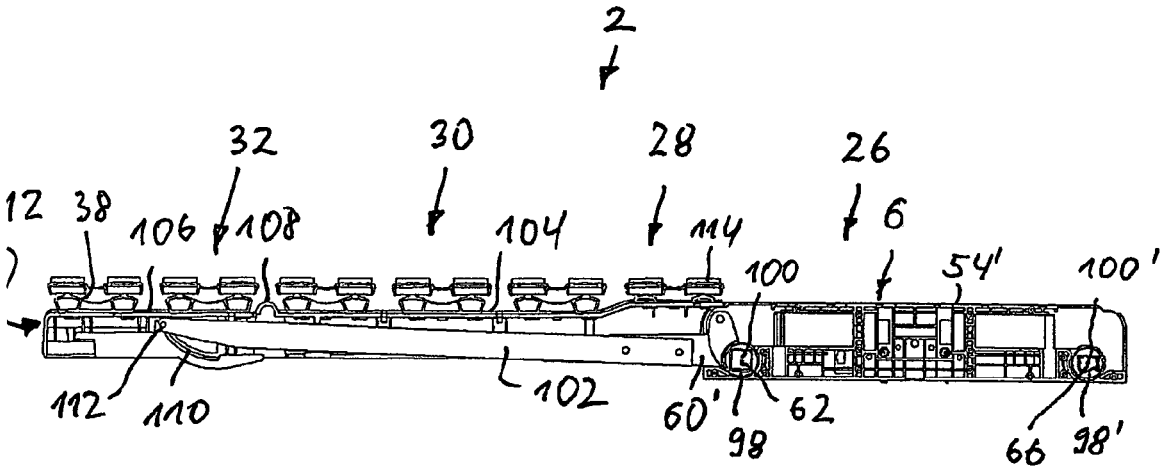
FIG. 4 is a second longitudinal rail assembly of the modular system as shown in FIG. 1 in the same view as in FIG. 3 yet on a smaller scale.

FIG. 4 shows a longitudinal section through the second longitudinal rail assembly 6 and the portion of the second longitudinal rail 12 forming the head support 32, the upper body support 30 and the lumbar support 28.

In this embodiment the second longitudinal rail assembly 6 is also realized as a hollow section. In contrast to the first longitudinal rail assembly 4, the second longitudinal rail assembly 6 though not designed as a housing 54' for containing portions of a drive mechanism, is in fact realized for containing portions of a drive mechanism. If required by the particular requirements, for example, in the case of slatted frames of greater width, the second longitudinal rail assembly 6 can, however, in the manner corresponding to that of the first longitudinal rail assembly 4 contain the parts of a wider drive mechanism.

In this embodiment a third pivot shaft 98 is mounted coaxially to the first pivot shaft 82 mounted in the first longitudinal rail assembly 4 in the assembled state.

Furthermore, in the second longitudinal rail assembly 6 a fourth pivot shaft 98' is mounted coaxially to the second pivot shaft 82 in the assembled state. The third pivot shaft 98 and the fourth pivot shaft 98' each features a continuous recess 100 and 101', respectively, which feature an substantially square cross section, as is described above for the recesses 84 and 84' of the first 82 and second pivot shafts 82'. A pivot lever 60' corresponding to pivot lever 60 is connected to the third pivot shaft 98, while a pivot lever 64' not illustrated in FIG. 4 and corresponding to the pivot lever 64 is connected to the fourth pivot shaft 98'.

The housing 54' features axially on both sides of the third pivot shaft 98 coaxial recesses thereto. Furthermore, the housing 54' features axially on both sides of the pivot shaft 98, coaxial recesses thereto.

The connecting shaft 40 can be inserted loosely by one end into the recess 84 of the first pivot shaft 82 and by its other end into the recess of the third pivot shaft 98 to form transmission element for transmitting a rotation of the first pivot shaft 82 to the third pivot shaft 98. In a corresponding manner the connecting shaft 42 can be inserted loosely by its one end into the recess 84' of the second pivot shaft 82' and with its other end into the recess 100' of the fourth pivot shaft 98' to form the transmission element for transmitting a rotation of the second pivot shaft 82' to the fourth pivot shaft 98'. Owing to the complementary design of the outer cross section of the connecting shafts 40 and 42, respectively, and the cross section of the recesses 84, 100 and 82', 100, respectively, the connecting shafts 40, 42 have a nonrotatable circumferential, yet loose axial connection with the pivot shafts 82, 98 and 82', 98', respectively, in assembled state.

To assemble the slatted frame 2 a lever extension 102, which, for example, can be clipped onto the pivot lever 60, is first attached nonrotatably to the lever 60 connected to pivot axle 62.

A casing 104 is then connected to the lever extension 102 at its end facing the second longitudinal rail assembly 6. In this embodiment, the casing 104 is formed by a hollow element, which in this embodiment is realized as U-shaped and open on the bottom in the assemble state of the slatted frame 2, as a schematic diagram in FIG. 6 of a corresponding casing for pivot lever 64 illustrates. The casing 104 is detachably connected to the lever extension 102 of the pivot lever 102. For example, it can be snapped or clipped onto the lever extension 102.

At its end facing away from the second longitudinal rail assembly 6 the casing 104 features a segment 106, which in this embodiment constitutes the first longitudinal rail segment. The segment 106 can be realized as one piece with the casing 104 and can be connected thereto via a hinge-like connection 108. The segment 106, however, can also be realized as a separate casing. Disposed in the interior of the segment 106 is an arc-shaped guide 110, in which, in the assembled state of the slatted frame 2, a stud 112 present on the end of the lever extension 102 facing away from the second longitudinal rail assembly 6 is displaceably guided.

As FIG. 4 illustrates, in this embodiment the upper surface of the casing 104 forms the upper surface of the second longitudinal rail 12.

In a corresponding manner, a corresponding casing 104' is provided on the pivot lever 60, which is connected to the first longitudinal rail assembly 4.

On the upper surface of the casings 104, 104' recesses are present, into which the retaining elements 38 for the flexible stats, of which a slat labeled 114 is shown in FIG. 4, can be inserted through the upper surface of the casing 104 and thereby detachably connected to the casing 104.

Figure 5:
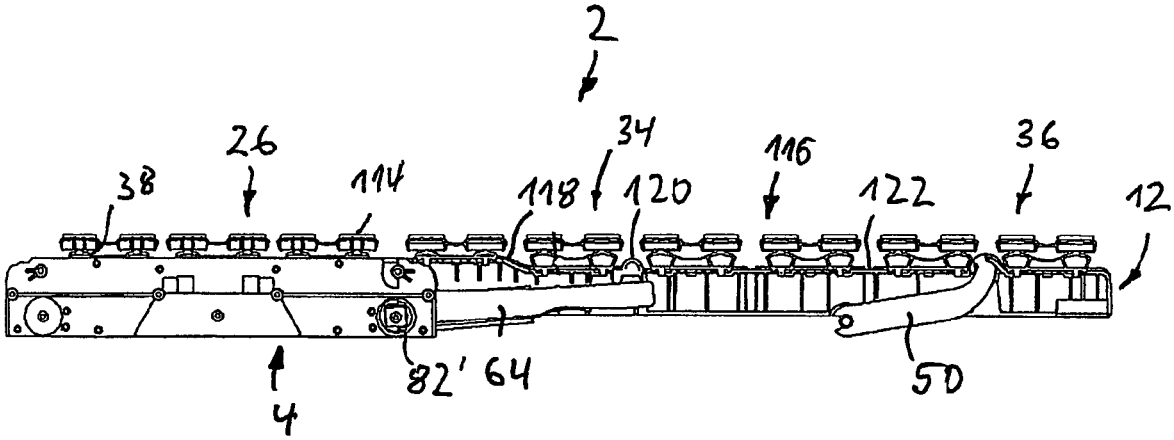
FIG. 5 is a side view of the longitudinal rail assembly as shown in FIG. 2 in the assembled state.

As FIG. 5 illustrates concerning the second longitudinal rail assembly, retaining elements 38' for flexible slats 114' are detachably connected to the longitudinal rail assemblies 4, 6, which form the fourth longitudinal rail segments 20 and 20', respectively, in the assembled state of the slatted frame 2.

To form the fifth longitudinal rail segment 22' and the sixth longitudinal rail segment 24' of the second longitudinal rail 12, a casing 116 is connected to the pivot lever 64', wherein the connection between the casing 104 and the pivot lever 64' is achieved in the same manner as is described for the casing 104 and the pivot lever 60'. The casing 116 features a first segment 118, which rests on the pivot lever 64' and is attached to a second segment 122 via a joint-like connection element 120. The second segment 122 is connected removed from its ends to the free end of the arm 50'. The free end of the arm 50' is connected to the second segment 122 at a site removed from the ends thereof. Through the arm 50' it is ensured, in a manner described in further detail below, that when the fifth longitudinal rail segment 22' pivots, the sixth longitudinal rail segment 24' pivots along with it.

In a corresponding manner, a corresponding casing 116 is connected to the longitudinal rail segments 22, 24 of the first longitudinal rail 10.

Figure 6:
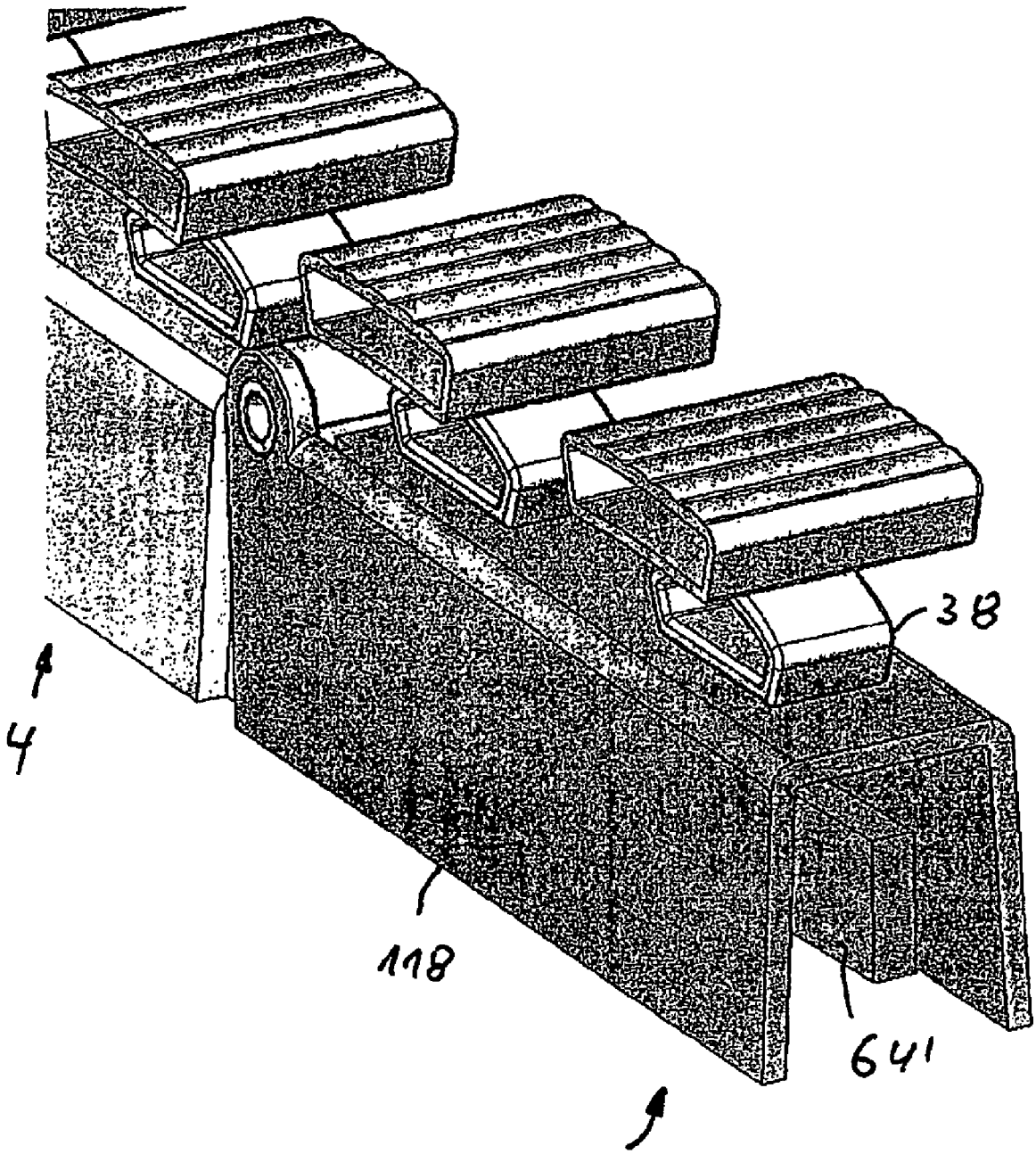
FIG. 6 is a perspective illustration of a detail from the casing of a pivot lever.

FIG. 6 is a highly schematic drawing of a portion of the casing 116 from the first segment 118, wherein it is visible that in this embodiment the casing 116 is realized as a U-shaped hollow section open on the bottom, while bearing on its upper surface the retaining elements 38 for the slats not illustrated in FIG. 6.

Thus, the second longitudinal rail 12 of the slatted frame is formed by the lever extension 102 being connected to the pivot lever 60' of the second longitudinal assembly group 6, the casing 104 being placed on the lever extension 102, the casing 116 being placed on the pivot lever 64' and the casing 116 being placed on the arm 50.

The first longitudinal rail 10 is formed in a corresponding manner.

Figure 7:
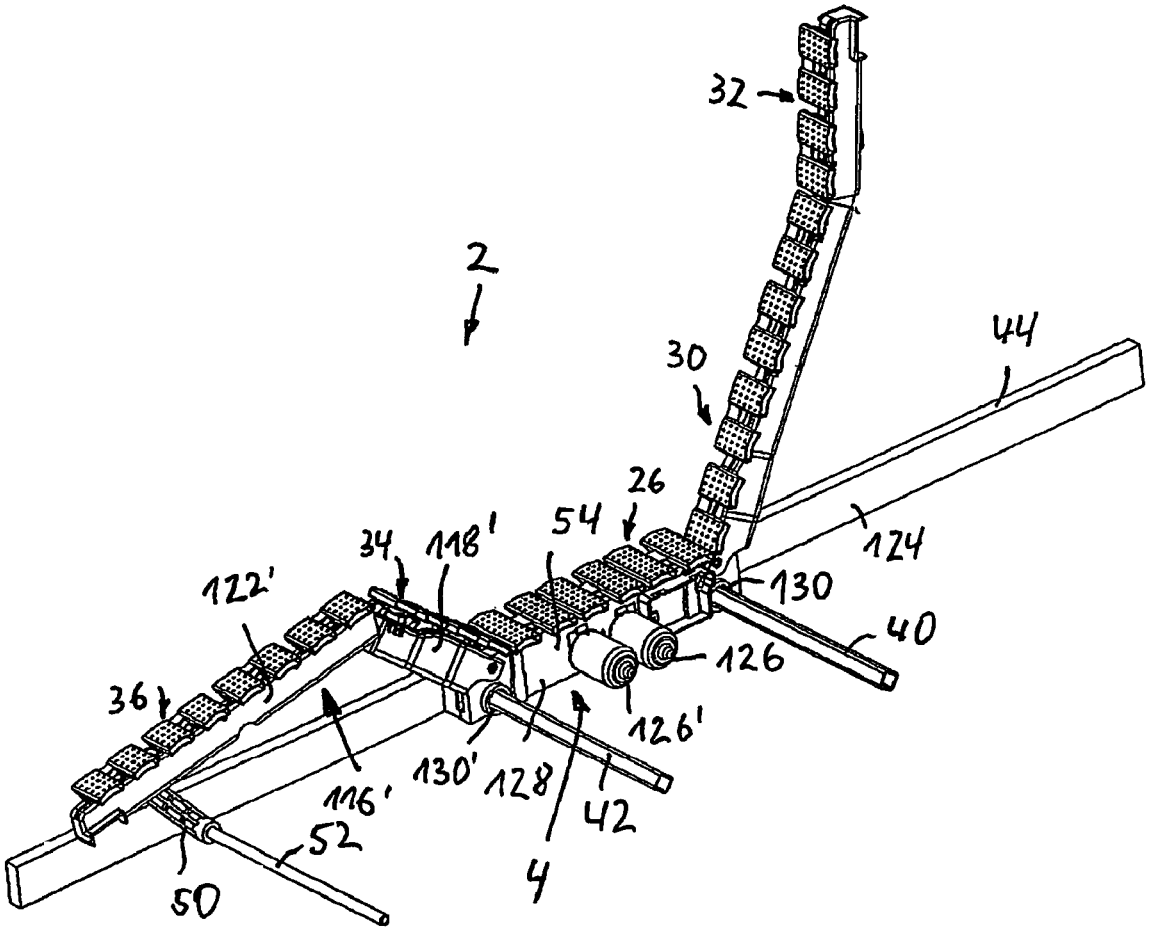
FIG. 7 is a perspective view of an inventive slatted frame in partly assembled state.

FIG. 7 shows the first longitudinal rail 10 in assembled state on the rail 44 of the frame of the slatted frame 2.

To assemble the first longitudinal rail assembly 4 this part is screwed to the inside 124 of the rail 44 via a screw not illustrated in the drawing.

Into a drill hole formed in the inside 124 of the rail 44 and not illustrated in the drawing, the axle 52 is loosely inserted, which in assembled state forms a mounting axle for pivotally mounting the end of the arm 50 facing away from the casing 116'.

In FIG. 7 an electric motor 126 belonging to the drive unit 58 and an electric motor 126 belonging to the drive unit 58' are visible. Only the electric motor 126 shall be described in further detail below. The electric motor 126' is realized and disposed in a corresponding manner.

In this embodiment the electrical motor 126 is disposed outside the first longitudinal rail assembly 4, wherein a recess not visible in the drawing is formed in a wall 128 of the first longitudinal rail assembly 4 facing the second longitudinal rail assembly 6, through which the drive motor 126 is in a driven connection with the parts of the drive unit 58 disposed in the interior of the first longitudinal rail assembly 4. As described above, the output shaft of the electric motor 126 is realized as a worm gear, which constitutes the first gear element and projects into the interior of the first longitudinal rail assembly 4.

In the assembled state of the slatted frame 2, the worm gear engages the worm wheel 70 mounted in the interior of the first longitudinal rail assembly and constituting a second gear element.

As FIG. 7 illustrates, the electric motors 126, 126' are disposed in essence completely outside the first longitudinal rail assembly 4 and therefore outside the first longitudinal rail 10. Furthermore, from FIG. 7 and FIG. 2 it is clear that in side view the electric motors 126, 126' are disposed within the profile height of the first longitudinal rail assembly 4 in such a manner that they are disposed on the first longitudinal rail assembly 4 without projecting above it. The electric motors 126, 126' are hereby disposed at the side of the first longitudinal rail assembly 4 facing the second longitudinal rail assembly 6 not pictured in FIG. 7 in such a manner that they are disposed between the longitudinal rail assemblies 4,6.

Following the mounting of the first longitudinal rail 10 on the rail 44, the connecting shaft 40 is loosely inserted into the recess 84 of the first pivot shaft 82 through a recess 130 in the housing 54 specifically created for this purpose. Because the recess 84 extends axially through the pivot shaft 82 and a recess corresponding to the recess 130 is present on the side of the housing 54 facing away from the recess 130 along the axis of the connecting shaft 40, the connecting shaft 40 strikes the inside of the rail 44 at the end of the insertion movement. In the assembled state of the slatted frame 2 the rail therefore forms a stopping element for limiting the axial insertion depth of the end of the connecting shaft 40 into the recess 84 of the pivot shaft 82.

In a corresponding manner, the end of the connecting shaft. 42 is loosely inserted axially through a recess 130' corresponding to recess 130 in the housing 54 and axially into the recess 84' of the second pivot shaft 82' until it strikes the inside 124 of rail 44, which thus forms a stopping element for limiting the axial insertion depth of the end of the connecting shaft 42 into the recess 84'.

As an alternative, it is possible to realize the housing 54 as axially closed to the pivot shaft 82, 82' on its side of the facing away the recesses 130, 103', therefore having on this surface no recess corresponding to recess 130,130'. In this embodiment an inner wall of the housing 54 facing away from the recess 130, 130' constitutes the stopping element. When the connecting shafts 40, 42 are inserted into the recesses, 84, 84' the ends of the connecting shafts 40, 42 strike the inner wall of the housing 54 at the end of each adjustment movement, so that the axial insertion depth of the connecting shafts 40, 42 into the recesses 84, 84' is limited.

Immediately following or prior to this step the arm 50 is pivotally connected to the axle 52. The end of the arm 50 facing the axle 50 can hereby be realized as elastically deformable in such a manner that this end can be snapped onto the axle 52. The connection can also be realized by bringing the recess formed in the end of the arm into alignment with the drill hole provided in the rail 44 for the insertion of the axle 52 and then inserting the axle 52 completely through the recess in the arm and into the drill hole.

Figure 8:
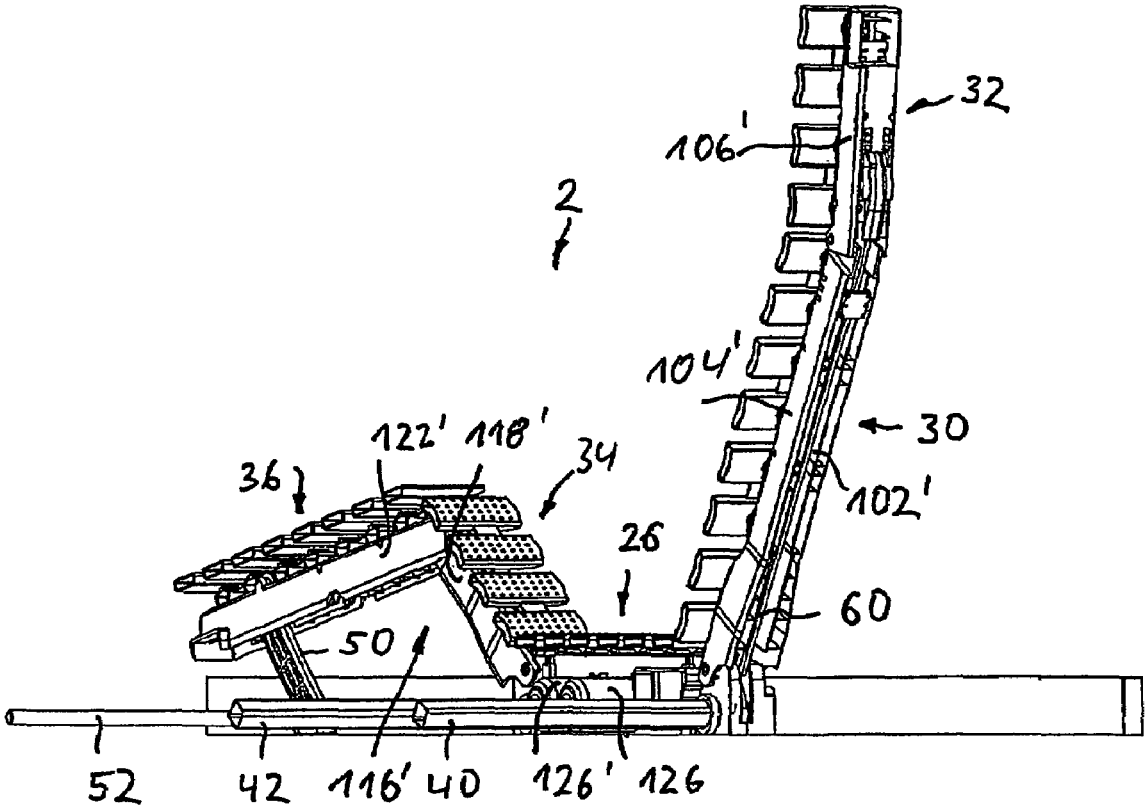
FIG. 8 is an additional perspective illustration of the partly mounted slatted frame as shown in FIG. 7.

FIG. 8 shows an additional perspective view of the first longitudinal rail 10 in partly assembled state, in which the connecting shafts 40, 42 are inserted into the recesses 84 and 84', respectively. Owing to the fact that the cross section of the recesses 84, 84' are substantially complementary to the outer cross section of the connecting shafts 40 and 42, respectively, in this state of assembly the connecting shafts 40, 42 are connected to the pivot shafts 82, 82' so that they are axially loose yet circumferentially nonrotatable.

Figure 9:
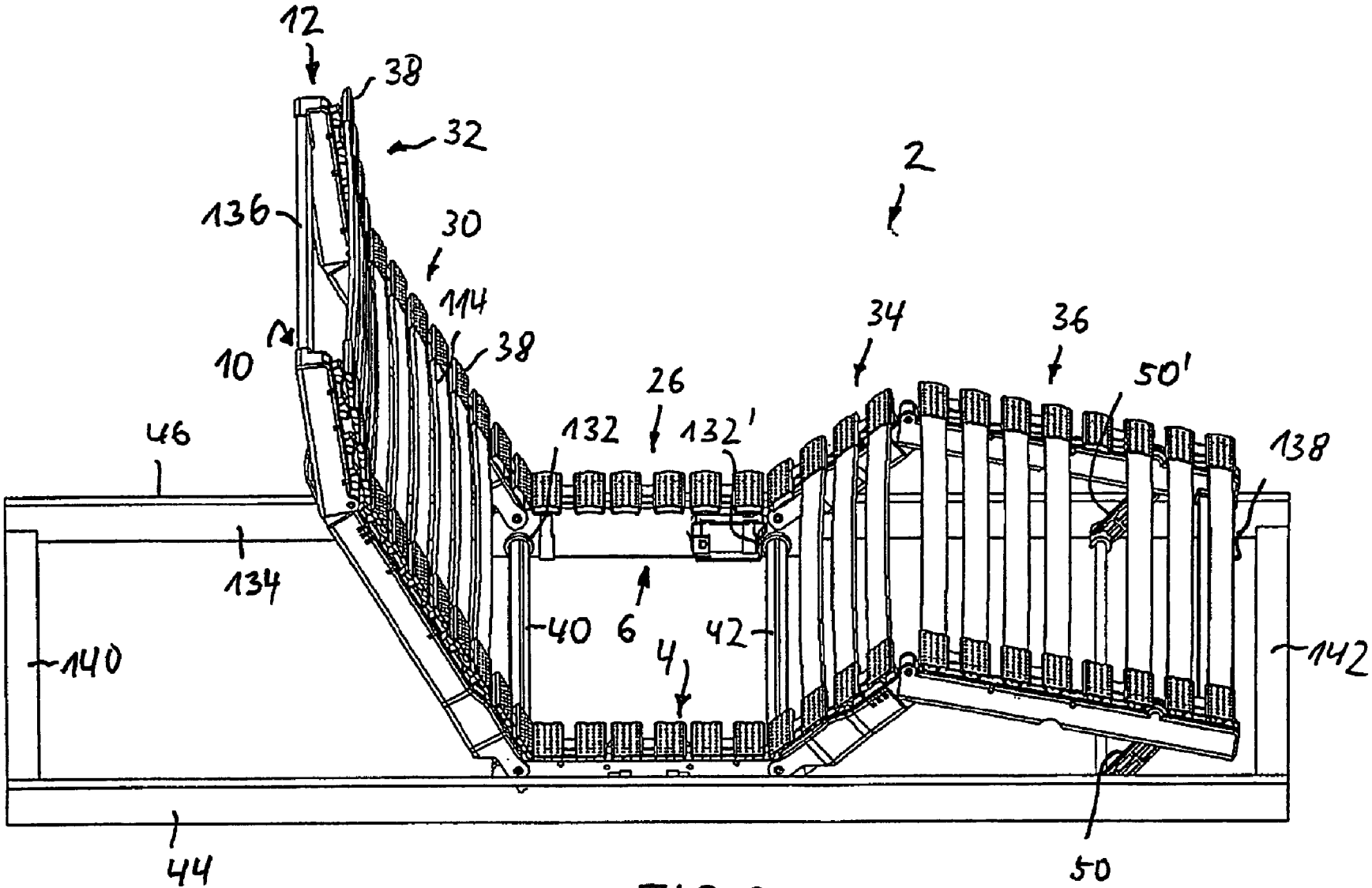
FIG. 9 is a perspective illustration of a slatted frame built from the modular system shown in FIG. 1, wherein several of the slats are omitted for clarity.

FIG. 9 shows the slatted frame 2 in assembled state.

To detachably connect the first longitudinal rail assembly 4 to the second longitudinal rail assembly 6 and thereby keep the first longitudinal rail 10 and the second longitudinal rail 12 spaced laterally apart from one another in accordance with the invention, the connecting shaft 40 is loosely inserted axially through a recess 132 in the second longitudinal rail assembly 6 and into the recess 100 of the third pivot axle 90 until the respective end of the connecting shaft 40 strikes the inside 134 of the rail 46. The rail 46 thus constitutes a stop to limit the axial insertion depth of the end of the connecting shaft 40 into the recess 100 of the third pivot shaft 98. Owing to the fact that the cross section of the recess 100 is substantially complementary to the outer cross section of the connecting shaft 40 a nonrotatable connection between the third pivot shaft 98 and the connecting shaft 40 is therefore achieved.

At the same time the connecting shaft 42 is inserted in a corresponding manner axially through a recess 132' in the second longitudinal rail assembly 6 and loosely into the recess 100' of the fourth pivot shaft 98'. At the same time the axle 52 is also inserted into a drill hole on the inside 134 of the rail 46 to pivotally mount the arm 50'.

In FIG. 9 it is can be seen that, in this embodiment, the connecting shafts 40, 42 constitute connection element for connecting the first longitudinal rail assembly 4 to the second longitudinal rail assembly 6 and therefore for connecting the first longitudinal rail 10 to the second longitudinal rail 12. Owing to the nonrotatable connection of the first pivot shaft 82 to the connecting rod 40 and the nonrotatable connection of the connecting shaft 40 to the third pivot shaft 98 the third pivot shaft 98 is coupled nonrotatably to the first pivot shaft 82, so that a rotation of the first pivot shaft 82 is transmitted to the third pivot shaft 98.

In a corresponding manner, the fourth pivot shaft 98' is coupled nonrotatably to the second pivot shaft 82', so that a rotation of the second pivot shaft 82' is transmitted to the fourth pivot shaft 98' and the connecting shaft 42 thereby forms transmission element for transmitting a rotation of the second pivot shaft 82' to the fourth pivot shaft 98'.

As the previous description demonstrates, the lateral spacing of the longitudinal rail assemblies 4,6 in relation to one another is determined by the axial length of the connecting shafts 40, 42. According to the invention, the connecting shafts 40, 42 therefore constitute a spacing element for establishing the lateral spacing of the longitudinal rail assemblies 4,6 and therefore the longitudinal rails 10, 12 to one another.

Thus, slatted frames of various widths can be assembled from a modular system provided if connecting shafts 40,42 of various axial lengths are used.

It is hereby especially advantageous if the connecting shafts 40, 42 are made of a profiled material, which has substantially the same cross section along its entire length and which is trimmed according to the desired width of the slatted frame 2. Thus slatted frames of various widths can be assembled from the inventive modular system using the same longitudinal rail groups 4, 6.

The assembly of the inventive slatted frame 2 can therefore be performed in an especially simple and quick manner, as in the embodiment all components of the slatted frame 2 are detachably connected to one another.

After the longitudinal rails 10, 12 are connected to one another in the manner described above, the retaining element 38 together with the flexible slats 114 are inserted into the recesses specifically provided in the upper surface of the longitudinal rails 10, 12 as described above.

At the longitudinal ends of the slatted frame 2, that is, in the free longitudinal end of the head support 32 and the free longitudinal end of the calf support optional transverse rails 136, 138 can then be mounted to improve the stability of the slatted frame. As FIG. 9 shows, however, the fixed center support 28 of the slatted frame 2 is realized as free of transverse rails, that is, rails absorbing bearing pressure. In this area the longitudinal rails 10, 12 are connected to one another solely through the connecting shafts 40, 42.

If required according to the particular demands, the outer frame of the slatted frame 2 can feature in its longitudinal free ends cross beams 140, 142, which can be detachably connected to the rails 44, 46.

In FIG. 9 the slats present in the center support 26 and therefore in the area of the longitudinal rail assemblies 4, 6 are omitted for clarity.

Figure 10:
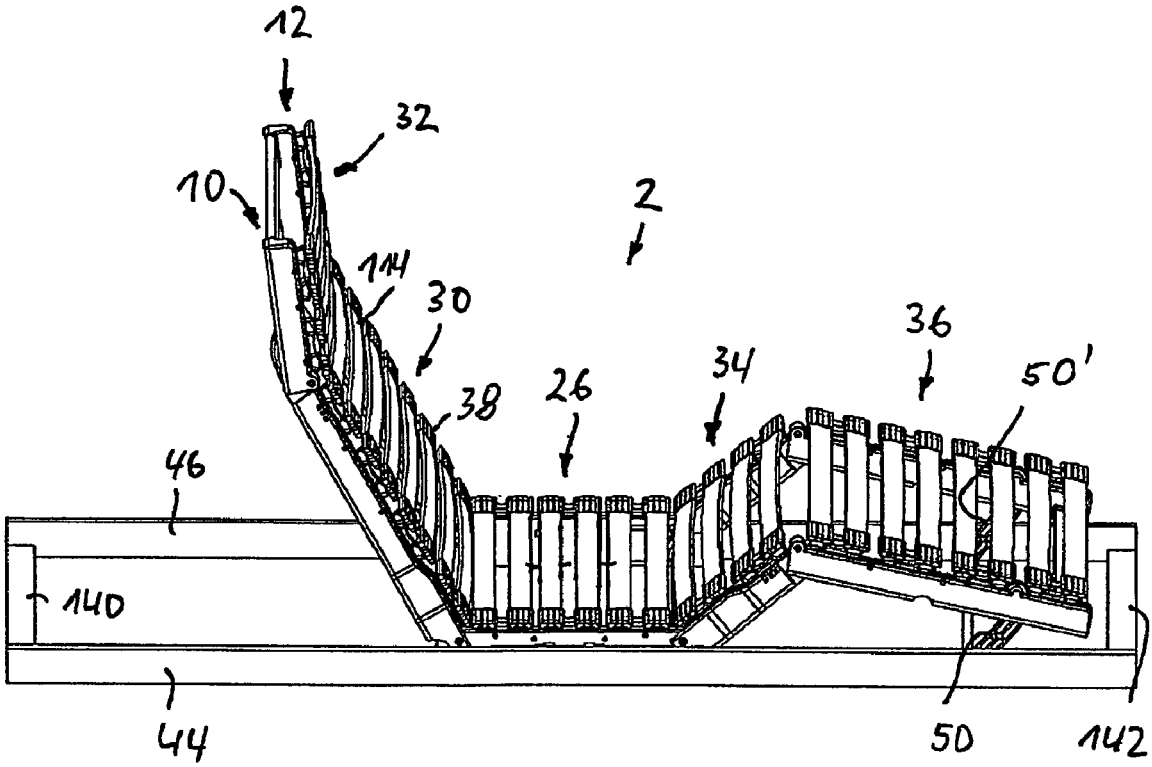
FIG. 10 is a slatted frame shown in the same view as in FIG. 9 yet in smaller scale than in FIG. 9, wherein all slats are illustrated.

FIG. 10 features an illustration similar to that of FIG. 9, wherein the slats of the center support 26 are illustrated.

Figure 11:
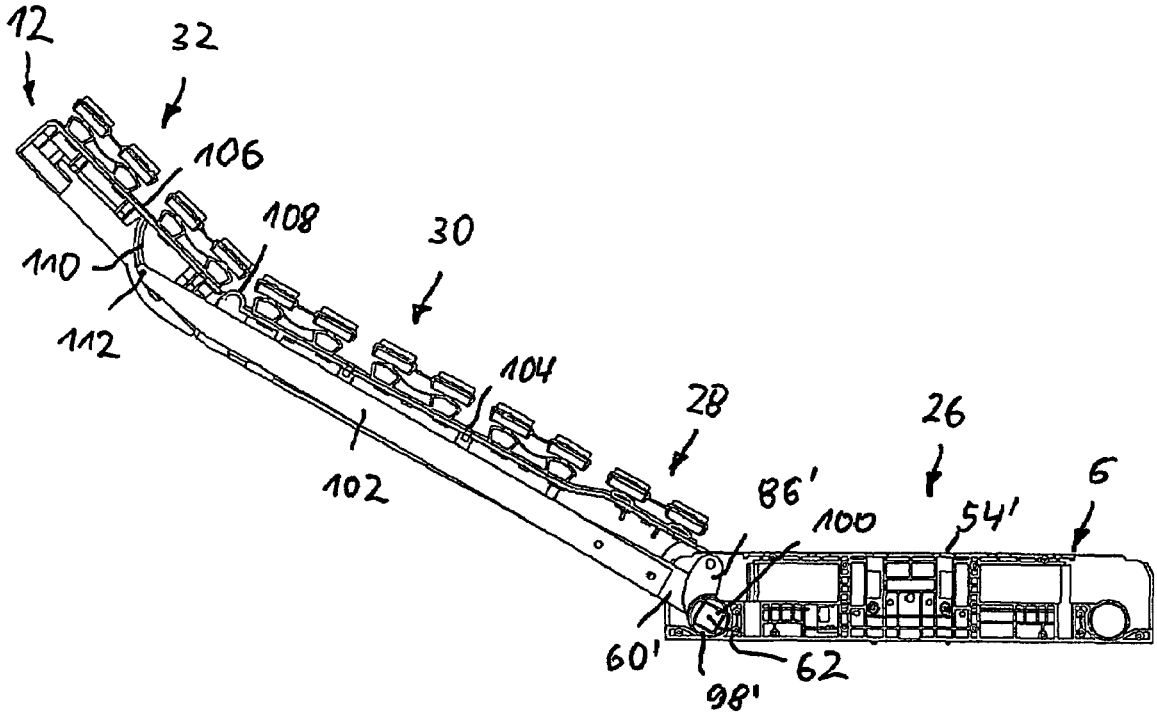
FIG. 11 is the longitudinal rail assembly as shown in FIG. 4 in the same view as FIG. 4 with the support elements in an adjustment setting.

The adjustment of the upper body support 30 and of the head support 32 relative to the center support element 26 by means of the drive unit 58 is described in further detail below in conjunction with FIGS. 4, 11 and 12.

FIG. 4 shows the upper body support 30 and the head support 32 in a first final adjustment setting of the adjustment movement, in which these support elements together with the center support 26 span a substantially horizontal support surface.

To adjust the upper body support 30 and the head support 32 relative to the center support 26 starting from this final adjustment setting, the first pivot shaft 82 (compare to FIG. 2) is pivoted clockwise in the drawing by means of the drive unit 58, wherein the rotation of the first pivot shaft 82 is transmitted via the connecting shaft 40 to the third pivot shaft 98, which is thus taken with the first pivot shaft 82 during its rotation and pivoted clockwise in FIG. 4. When the pivot shaft 82, 98 is pivoted the levers 60', 60 connected to the pivot shafts pivot synchronously, so that the upper body support 30 in FIG. 4 pivots clockwise as FIG. 11 illustrates. The head support 32 hereby moves relative to the upper body support 30 and partly owing to the fact that the studs 112, 112' present on the lever extensions 102, 102 are guided in the arc-shaped guides 110, 110' of the head support 32.

Figure 12:
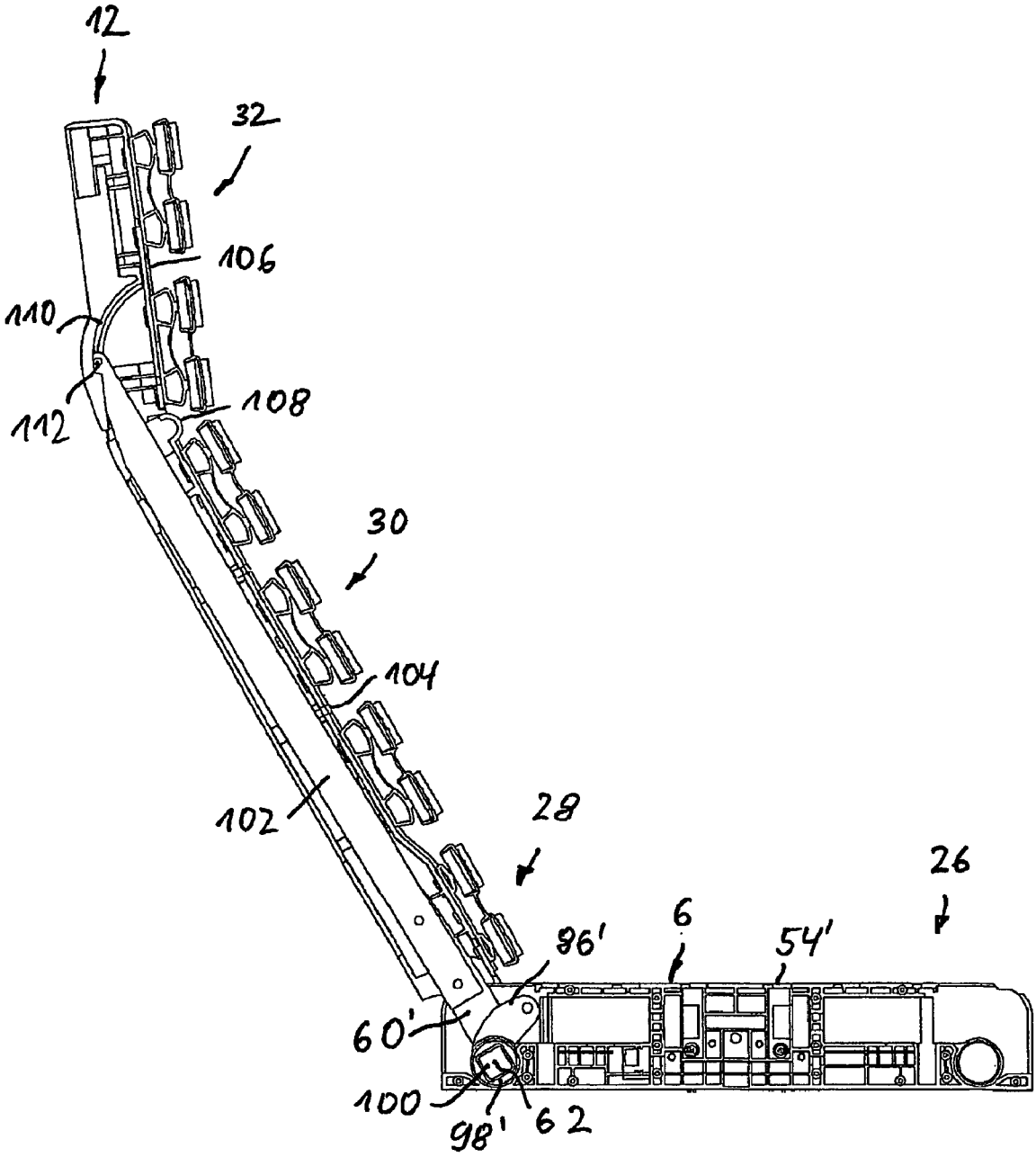
FIG. 12 is the longitudinal rail assembly as shown in FIG. 4 in the same view as in FIG. 11 yet on a larger scale with the supports in final adjustment setting.

FIG. 12 illustrates the other final adjustment setting of the adjustment movement, in which the head support 32 and the upper body support 30 are adjusted to the maximum setting relative to the center support 26.

Returning the upper body support 30 and the head support 32 from the final adjustment setting of the adjustment movement shown in FIG. 12 to the final adjustment setting of the adjustment movement shown in FIG. 4 occurs when the drive unit 58 is powered, however, also under the influence of the weight of the upper body support 30 and the head support 32 and as well as under the load of a person resting thereon.

Figure 13:
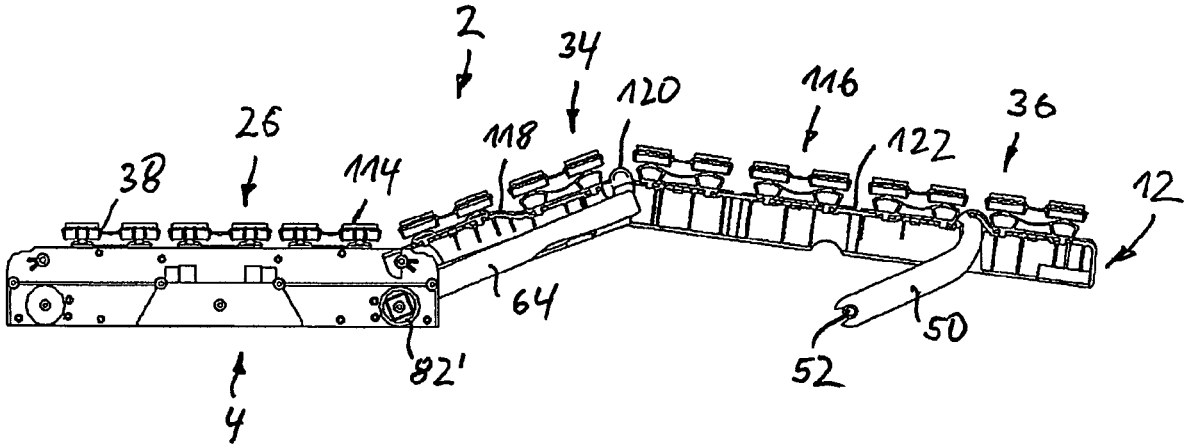
FIG. 13 is a longitudinal rail assembly in the same view as in FIG. 5 with the supports as shown in FIG. 5 in an adjustment position.

The adjustment of the leg support 34 and the calf support 36 relative to the center support is described in further detail below in conjunction with FIGS. 5, 13, and 14.

FIG. 5 shows the first final adjustment setting of the adjustment movement, in which the leg support 34 and the calf support 36 form together with the center support 26 a substantially horizontal support surface.

Starting from this final adjustment setting the second pivot shaft 82 and, via the connecting shaft 42, the fourth pivot shaft 98, are pivoted counterclockwise in FIG. 5 by means of the drive unit 58, so that the pivot lever 64 is also pivoted counterclockwise. The leg support 34 and, owing to the hinged connection with the leg support 34, the calf support 36 are hereby pivoted as is illustrated in FIG. 13. The kinematics of the pivot movement of the calf support 36 relative to the leg support 34 and the center support 26 are hereby determined by the arm 50, 50'.

Figure 14:
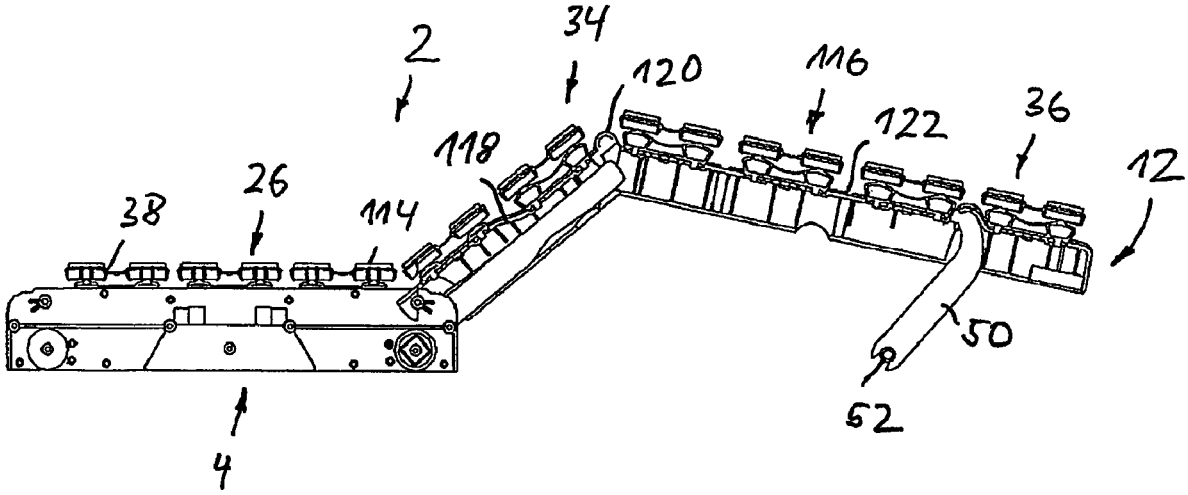
FIG. 14 is the longitudinal rail assembly in the same view as in FIG. 13 with the supports as shown in FIG. 13 in a final adjustment setting of the adjustment movement.

FIG. 14 shows the other final adjustment setting of the adjustment movement of the leg support 34 and of the calf support 36, in which these are adjusted to the maximum setting relative to the center support 26.

Returning the leg support 34 and the calf support 35 to the final adjustment setting of the adjustment movement shown in FIG. 5 occurs when the drive unit is powered 58' also, however, under the influence of the weight of the leg support 34 and the calf support 36 and as well as under the load of a person resting on the slatted frame 2.

As the description above demonstrates, support apparatuses, for example, slatted frames, of various widths can be assembled from the inventive modular system using the same longitudinal rail assemblies. The longitudinal rail assemblies as well as the connecting element, with which the longitudinal rail assemblies for forming the base of the support apparatus can be spaced apart laterally and connected to one another, constitute fundamental components of the inventive modular system and the inventive support device.

Support apparatuses of various widths can hereby be realized by using connecting shafts 40,42 of various lengths. The width of the slats or other suspension elements employed are adapted to the particular length of the connecting shafts and thereby the lateral spacing of the longitudinal rails 10, 12 of the support apparatus.

To facilitate an emergency lowering of the supports 30, 32, when these are adjusted relative to the center support 26 and, for example, a power outage occurs, the rod 90 is realized as a disengagable component in this embodiment. To activate disengagement, a rod-shaped actuating element 114 is provided, which extends substantially perpendicular to the linear movement axis of the spindle nut 76 and projects from the housing 54 through an opening in the upper surface thereof. The actuating element rests on a lower interior wall of the housing 54 via a coil spring 146, which is coaxially disposed on a neck 148 of the actuating element 144. Provided on the actuating element 144 and running substantially perpendicular to the longitudinal axis thereof is a stud 150, which in this drawing runs perpendicular to the drawing plane and on the upper surface of which the rod 90 rests loosely. In the engaged position illustrated in FIG. 15A the actuating element 144 is biased or pretensioned upwards by the coil spring 146 in FIG. 15A.

To actuate the disengagement, the upper body support is manually moved a short distance clockwise (compare FIG. 12), so that the pivot lever 60 in FIG. 60 is pivoted a short distance clockwise.

Figure 15A:
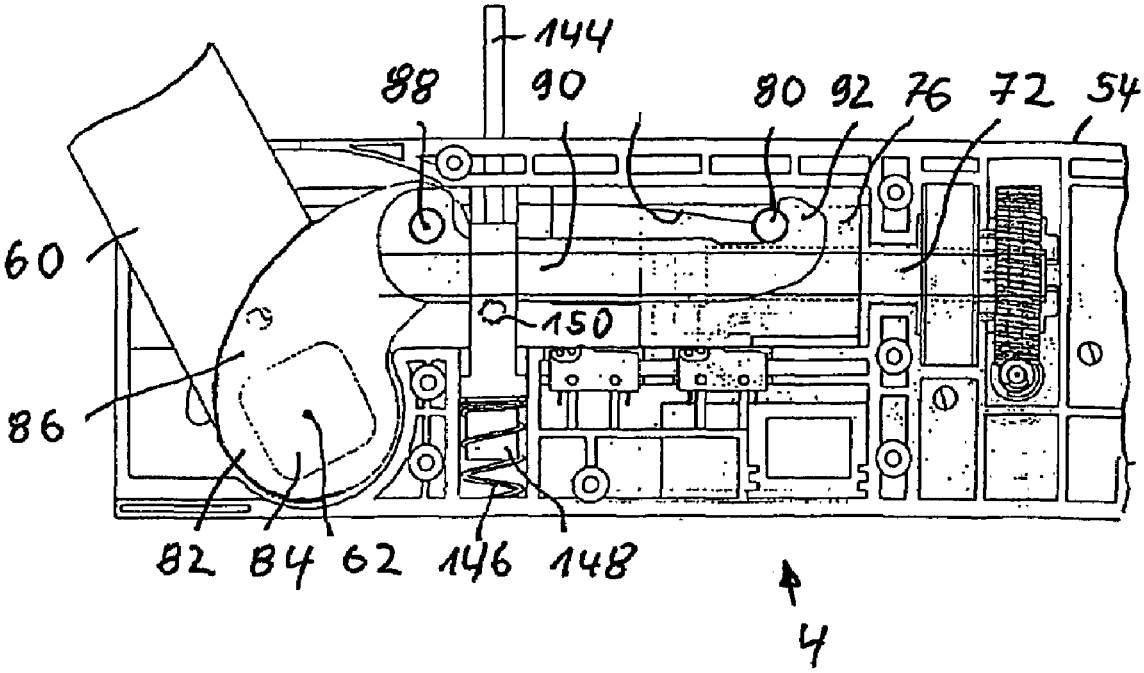
FIGS. 15A through 15F is a disengagement procedure of a disengageable component for interrupting the drive train to perform an emergency lowering of the head support of the slatted frame as shown in FIG. 9 in the same view as in FIG. 3.
Figure 15B:
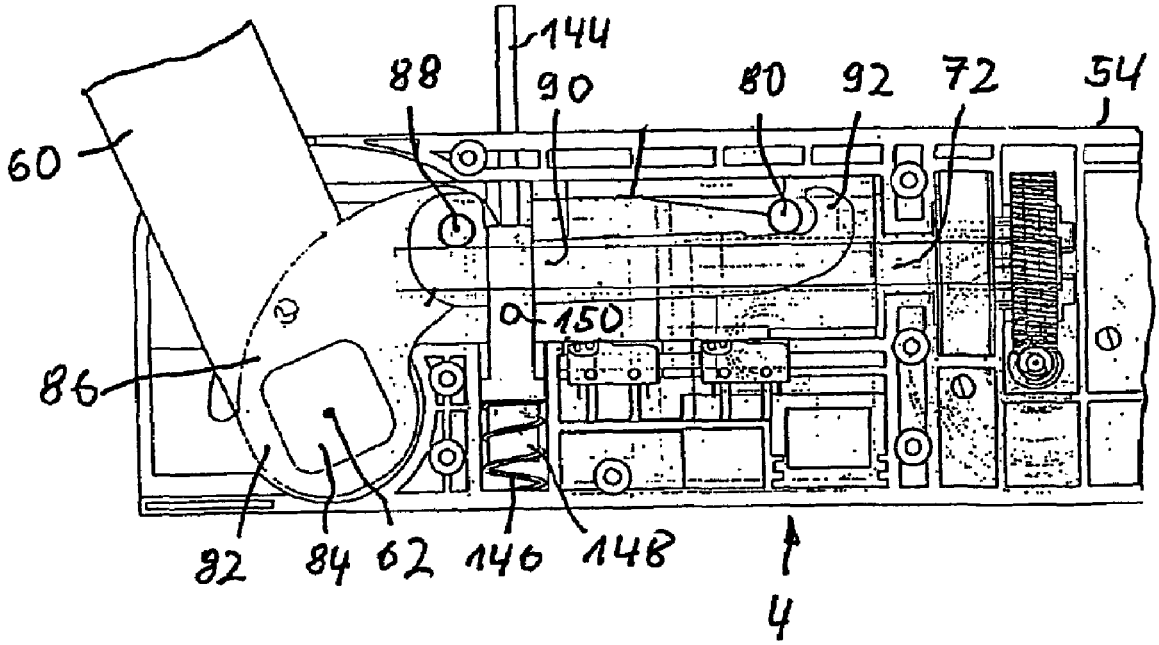

The hook 92 is hereby disengaged from the stud 80, as FIG. 15B illustrates.

Figure 15C:
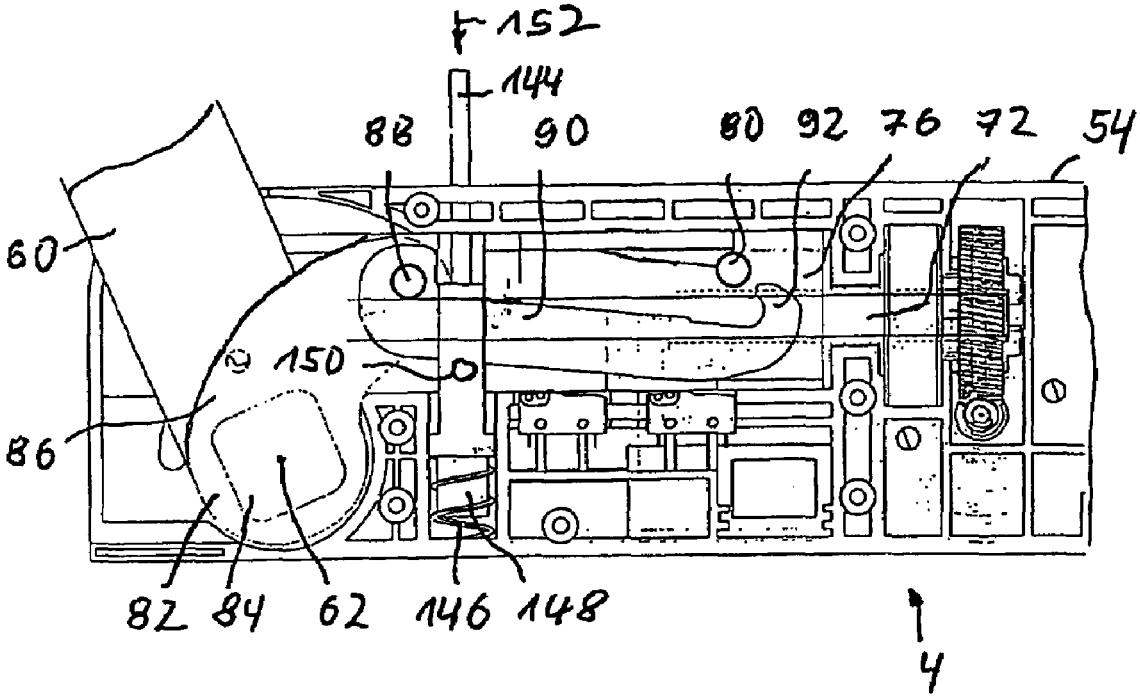

The user then presses the actuating element 144 in FIG. 15C downward in the direction of the arrow 152, so that the hook 92 unhooks from the stud 80, as FIG. 15C illustrates.

Figure 15D:
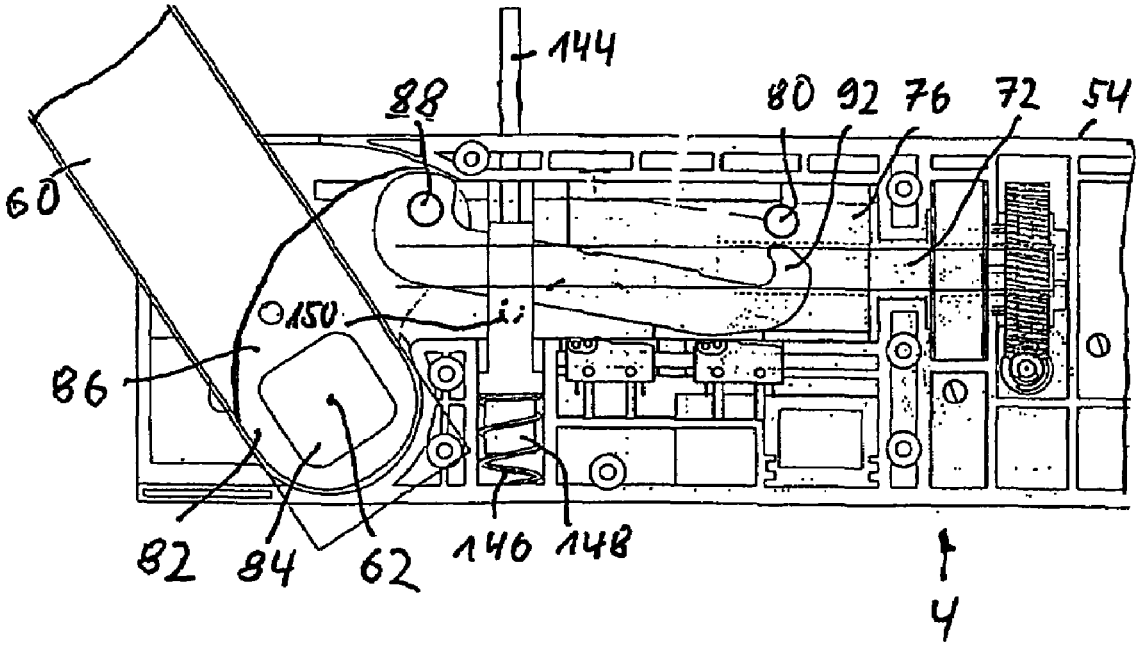

With the rod 90 thus no longer in a cooperative engagement for being drawn along in connection with the stud 80, the upper body support 30 lowers under its own weight, allowing the pivot lever 60 to pivot clockwise in the drawing, as FIG. 15D illustrates.

Figure 15E:
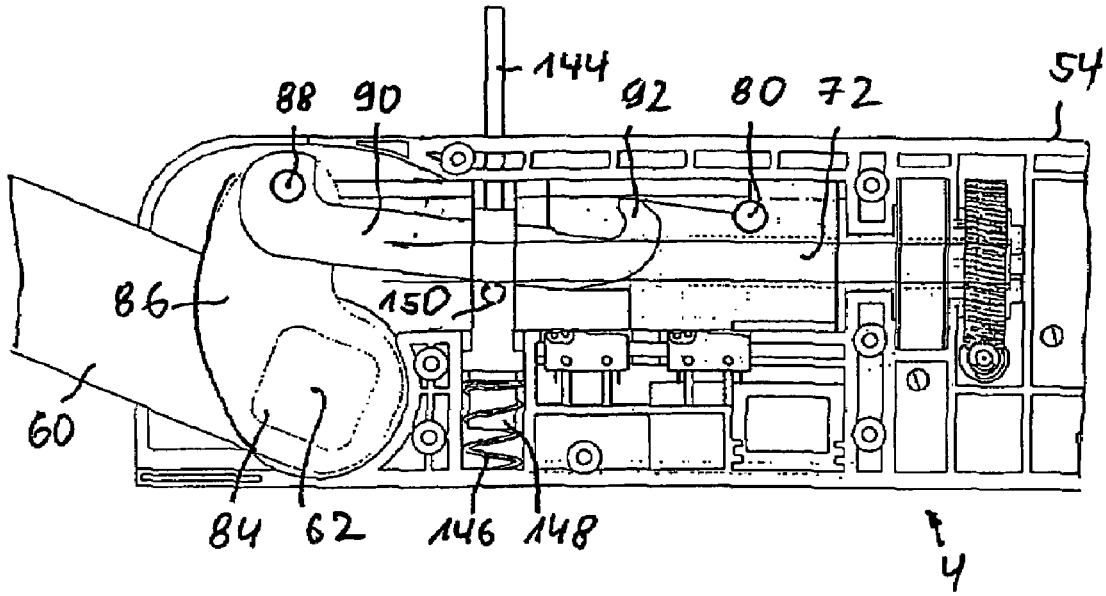
Figure 15F:
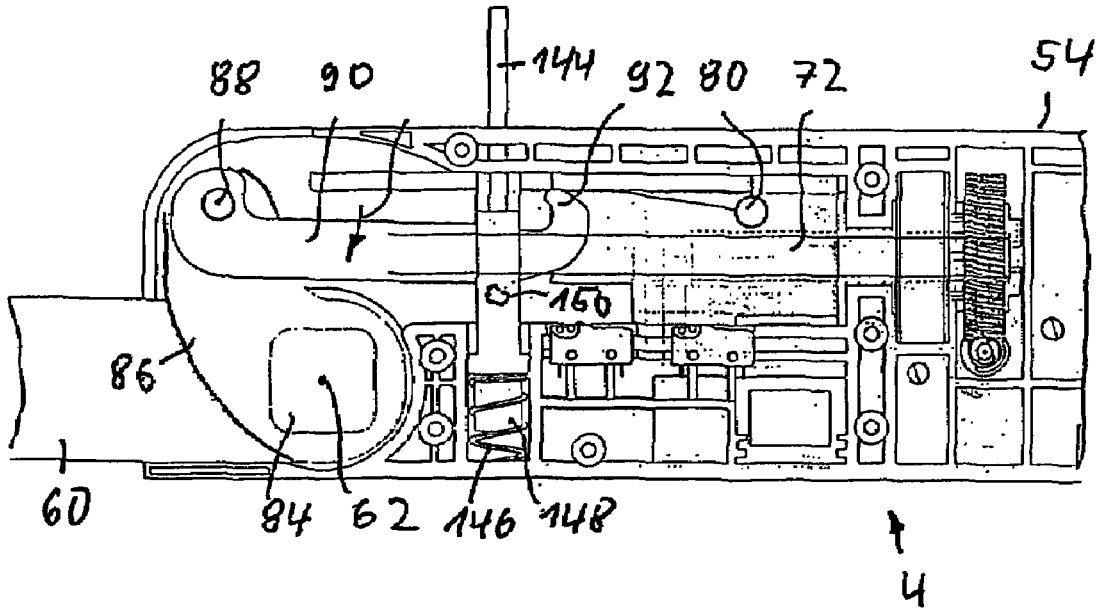

As FIGS. 15E and 15F illustrate, the upper body support 30 can be lowered manually in this manner.

Figure 16A:
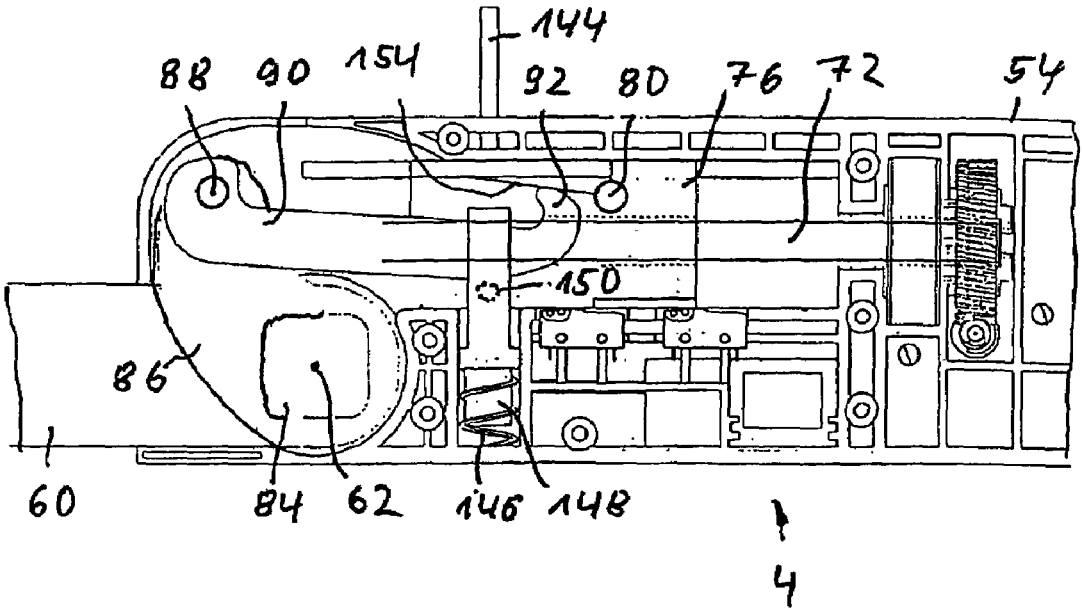
FIGS. 16A through 16E are an engagement procedure for the disengaged component in the same manner as in FIG. 3.

To return the rod 90 to pulling connection with the stud 80 and thereby the spindle nut 76, the drive mechanism is actuated so that the spindle nut 76 moves to the left in FIG. 16A.

The hook 92 hereby runs along a guide surface 154, which runs at a sharp angle to the movement axis of the spindle nut 76 and leads to the stud 80, as FIG. 16A illustrates.

Figure 16B:
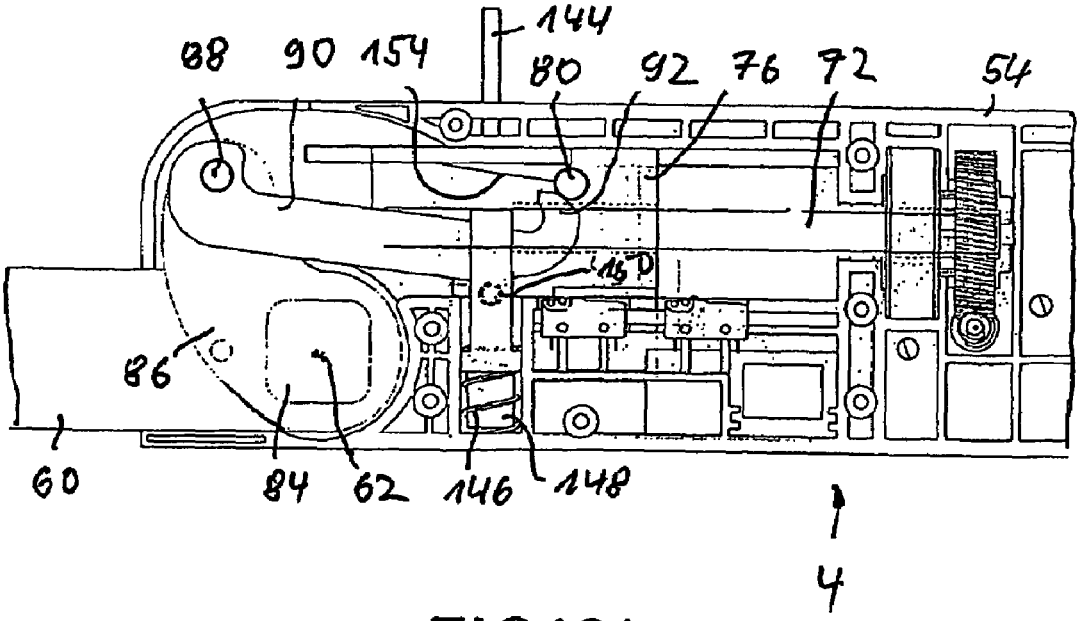

When the spindle nut 76 moves further to the left in FIG. 16A, the hook runs onto the outer circumferential surface of the stud 80, as FIG. 16B illustrates. Owing to the initial tension of the coil spring 146 the actuating element hereby pivots the rod 90 counterclockwise about the third pivot axle 80, so that the hook is pretensioned against the guide surface 154 as well as the circumferential surface of the stud 80.

Figure 16C:
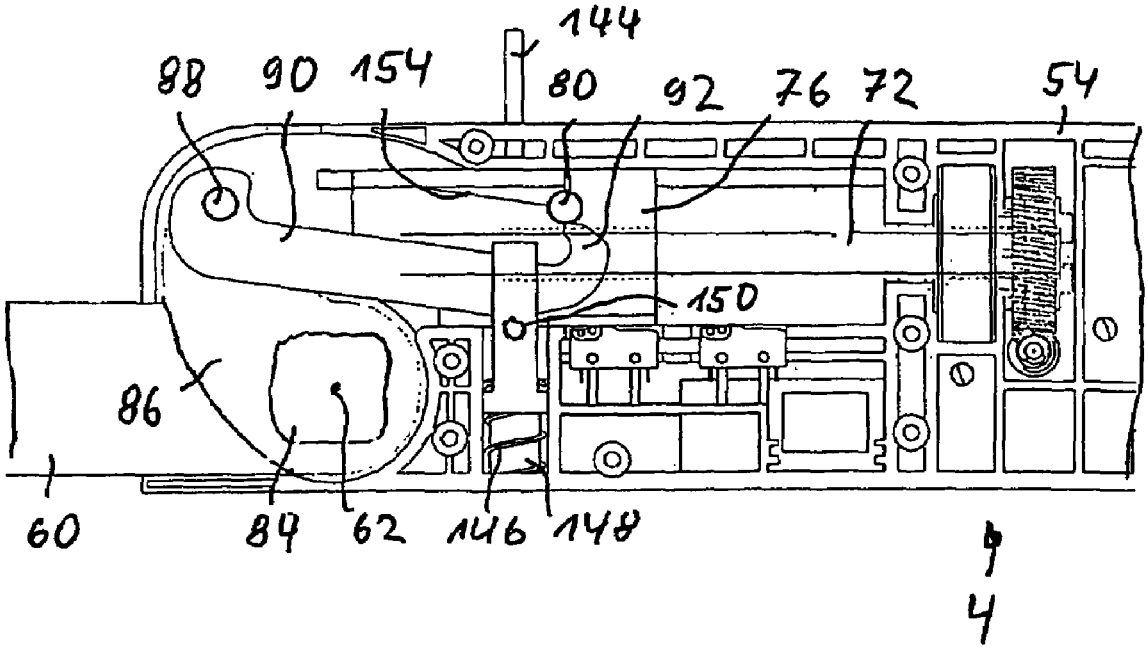
Figure 16D:
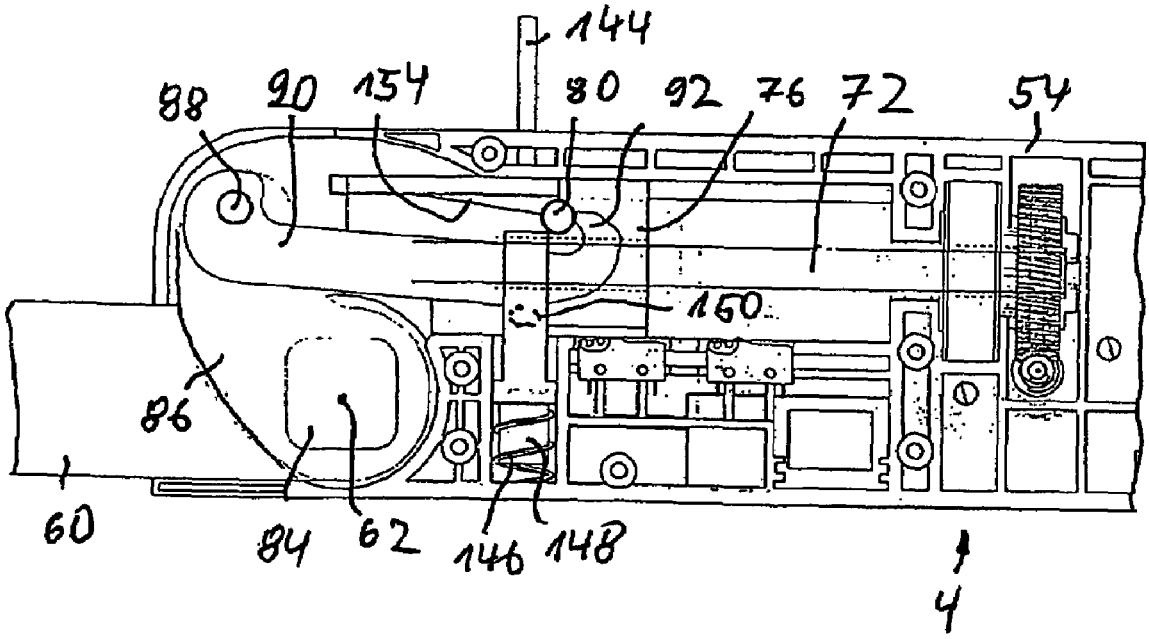
Figure 16E:
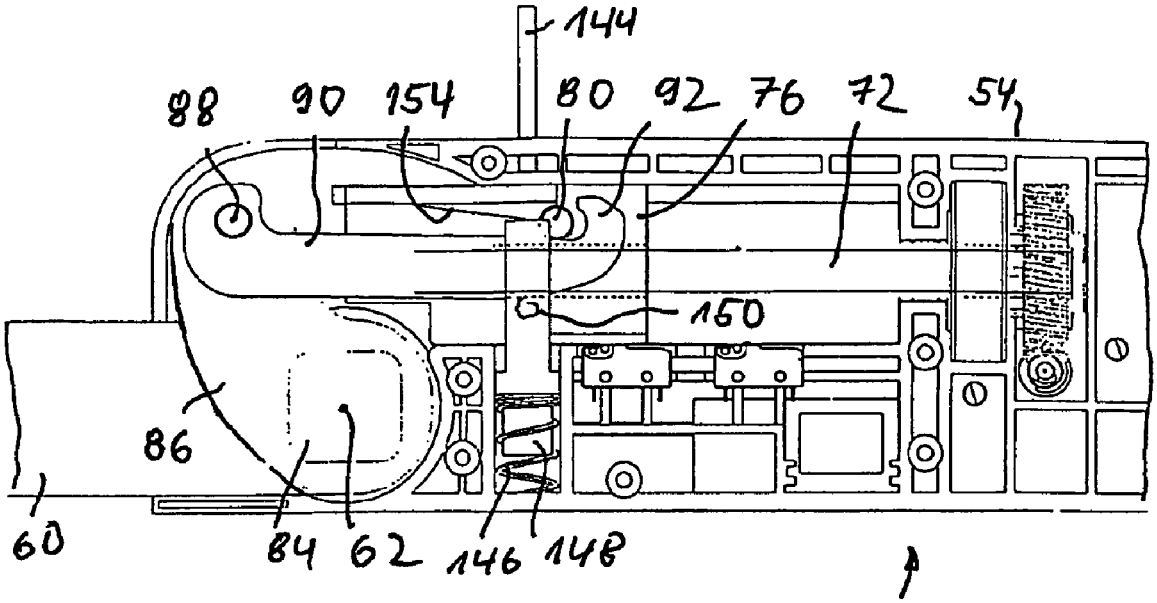

When the spindle nut 76 moves further to the left in FIG. 16B, the hook 92 hooks around the stud 80, as is illustrated in FIG. 16C, 16D, and 16E. If the spindle nut 76 is moved to the right again in the position shown in FIG. 16E, then the pulling connection between the hook 92 and the stud 80 is restored, so that the rod 90 is again in the engaged position and, when the spindle nut 76 moves further to the right in FIG. 16E, pivots the pivot lever 60 clockwise, so that the upper body support 30 and the head support 32 are also pivoted clockwise.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Modular system for assembling a motorized adjustable support apparatus for the upholstery of a piece of furniture for one of sitting and lying, comprising:

a) a first support element including a first longitudinal rail assembly;

b) a second support element including a second longitudinal rail assembly;

c) said first and second longitudinal rail assemblies being detachably connected by a connecting element to form a base of the support apparatus, in use;

d) in an assembled state the adjustable support apparatus includes the two support elements adjustable relative to one another for supporting the upholstery;

e) at least one connecting shaft being provided for transmitting the rotation of a first pivot shaft connected to the first longitudinal rail assembly to a third pivot shaft connected to the second longitudinal rail assembly; and f) ends of the at least one connecting shaft being detachably insertable into recesses defined in the first and third pivot shafts, and being securable against rotation with respect to the first and third pivot shafts.

2. Modular system as claimed in claim 1, wherein:

a) at least one of the longitudinal rail assemblies is configured as a housing for containing at least a portion of a drive mechanism.

3. Modular system as claimed in claim 2, wherein:

a) at least one of the longitudinal rail assemblies is configured as a one of a closed hollow section and open on one side.

4. Modular system as claimed in claim 2, wherein:

a) a drive mechanism is provided which includes at least one drive motor.

5. Modular system as claimed in claim 1, wherein:

a) a drive mechanism is provided which includes at least one drive motor;

b) the drive mechanism comprising at least a drive motor is contained in a housing provided in one of the rail assemblies.

6. Modular system as claimed in claim 4, wherein:

a) one of the drive motor and at least an end of the drive motor facing away from an output shaft of the drive motor is present outside the housing; and b) in a side wall of the first longitudinal rail assembly opposite the second longitudinal rail assembly a recess is formed, and the drive motor is in a driven connection through the recess with parts of the drive mechanism disposed in an interior of the first longitudinal rail assembly.

7. Modular system as claimed in claim 6, wherein:

a) one of the output shaft of the drive motor and an end of the drive motor bearing the output shaft of the drive motor or a first gear element in a driven connection with the output shaft of the drive motor projects through the recess and into the interior of the first longitudinal support assembly; and b) in the assembled state of the support apparatus the first gear element engages a second gear element present in the interior of the first longitudinal rail assembly.

8. Modular system as claimed in claim 4, wherein:

a) the drive motor is disposed substantially completely outside the first longitudinal rail assembly.

9. Modular system as claimed in claim 7, wherein:

a) the first gear element is a worm of a worm gear assembly, a worm wheel of which is disposed in the interior of the first longitudinal rail assembly and constitutes the second gear element.

10. Modular system as claimed in claim 9, wherein:

a) the worm is substantially nonrotatably connected to the output shaft of the drive motor.

11. Modular system as claimed in claim 4, wherein:

a) the at least one of the longitudinal rail assemblies is the first longitudinal assembly and is configured as a housing which includes a profile height; and b) in side view the drive motor is located within the profile height of the first longitudinal rail assembly in such a manner that the drive motor is disposed in or on the first longitudinal rail assembly without projecting vertically above the profile height.

12. Modular system as claimed in claim 4, wherein:

a) the drive motor is disposed on a side of the longitudinal rail assembly opposite the other longitudinal rail assembly in the assembled state in such a manner that the drive motor is disposed between the longitudinal rail assemblies.

13. Modular system as claimed in claim 1, wherein:

a) a drive mechanism is provided which includes at least one drive motor; and b) at least one of the longitudinal rail assemblies includes at least a pivot shaft rotatably mounted therewith, and which constitutes a drive component of the drive mechanism and in the assembled state of the support apparatus is in a driven connection with at least one part of the support apparatus to be adjusted.

14. Modular system as claimed in claim 13, wherein:

a) at least one of the longitudinal rail assemblies includes at least two pivot shafts mounted therewith, and, which in the assembled state of the support apparatus are provided on different support elements for the adjustment thereof.

15. Modular system as claimed in claim 13, wherein:

a) in the assembled state of the support apparatus each of the pivot shafts is in an actuating connection with the respective support element via a lever assembly.

16. Modular system as claimed in claim 15, wherein:

a) each lever assembly features a pivot lever, which is substantially nonrotatably connected to the respective pivot shaft.

17. Modular system as claimed in claim 16, wherein:

a) the pivot lever is fixedly connected to the respective pivot shaft.

18. Modular system as claimed claim 15, wherein:

a) the at least one of the longitudinal rail assemblies includes the first longitudinal rail assembly, the lever assembly includes a pivot lever, and the pivot lever constitutes a portion of the longitudinal rail.

19. Modular system as claimed in claim 13, wherein:

a) a transmission element is provided for transmitting the rotation of a first pivot shaft connected to the first longitudinal rail assembly to a third pivot shaft connected to the second longitudinal rail assembly and/or for transmitting a rotation of a second pivot shaft connected to the first longitudinal rail assembly to a fourth pivot shaft connected to the second longitudinal rail assembly.

20. Modular system as claimed in claim 19, wherein:

a) in the assembled state of the support apparatus the first and the third pivot shaft connect to the same support element to be adjusted.

21. Modular system as claimed in claim 19, wherein:

a) in the assembled state of the support apparatus the second and the fourth pivot shafts connect to the same support element to be adjusted.

22. Modular system as claimed in claim 19, wherein:

a) the transmission element connects the first and the third pivot shafts and/or the second and the fourth pivot shafts substantially nonrotatably to one another.

23. Modular system as claimed in claim 22, wherein:

a) the transmission element for creating a substantially nonrotatable connection between two pivot shafts features at least a connecting shaft.

24. Modular system as claimed in claim 23, wherein:

a) the connecting shaft is connected to the pivot shafts substantially nonrotatably circumferentially, yet loosely axially.

25. Modular system as claimed in claim 24, wherein:

a) the pivot shafts to be connected each features an axial recess with a square cross section and that the axial ends of the connecting shaft each features a cross section that is complementary to the respective recess in such a manner that the ends of the connecting shaft circumferentially engage the recesses in the pivot shafts in an essentially formfitting manner.

26. Modular system as claimed in claim 23, wherein:

a) the ends of the connecting shaft can be inserted loosely into the recesses in the pivot shafts.

27. Modular system as claimed in claim 26, wherein:

a) a stopping element is provided for limiting the axial insertion depth of the ends of the connecting shaft into the recesses in the pivot shafts.

28. Modular system as claimed in claim 27, wherein:

a) the stopping element is formed at least partly by an outer frame of the support apparatus in the assembled state of the support apparatus.

29. Modular system as claimed in claim 27, wherein:

a) each of the pivot shafts connected substantially nonrotatably to one another through a connecting shaft includes a stop.

30. Modular system as claimed in claim 1, wherein:

a) in the assembled state of the support device, each longitudinal rail is formed at least in sections by the respective longitudinal rail assembly lengthwise in the support device.

31. Modular system as claimed in claim 1, wherein:

a) in the assembled state of the support apparatus the respective longitudinal rail is formed at least in sections by the pivot lever as well as a casing of the pivot lever lengthwise in the support device.

32. Modular system as claimed in claim 1, wherein:

a) in the assembled state of the support apparatus the longitudinal rails are formed lengthwise in the support apparatus at least partly by profile elements.

33. Modular system as claimed in claim 18, wherein:

a) the at least one connecting shaft provided for transmitting the rotation of the first pivot shaft comprises a transmission element, and the connecting element is at least partly formed by the transmission element.

34. Motorized adjustable support apparatus for the upholstery of a piece of furniture for one of sitting and lying, comprising:

a) a first support element including a first longitudinal rail assembly;

b) a second support element including a second longitudinal rail assembly;

c) said first and second longitudinal rail assemblies being detachably connected by a connecting element to form a base of the support apparatus;

d) the two support elements being adjustable relative to one another for supporting the upholstery;

e) at least one connecting shaft being provided for transmitting the rotation of a first pivot shaft connected to the first longitudinal rail assembly to a third pivot shaft connected to the second longitudinal rail assembly; and f) ends of the at least one connecting shaft being detachably insertable into recesses defined in the first and third pivot shafts, and being securable against rotation with respect to the first and third pivot shafts.

35. Support apparatus as claimed in claim 34, wherein:

a) at least one of the longitudinal rail assemblies is configured as a housing to contain at least part of a drive mechanism.

36. Support apparatus as claimed in claim 35, wherein:

a) at least one of the longitudinal rail assemblies is configured as hollow section being one of closed or open on one end.

37. Support apparatus as claimed in claim 35, wherein:

a) the drive mechanism includes at least a drive motor.

38. Support apparatus as claimed in claim 35, wherein:

a) the drive mechanism including a drive motor is contained in the housing, and the drive motor having an output shaft.

39. Support apparatus as claimed in claim 38, wherein:

a) at least an end of the drive motor facing away from the output shaft of the drive motor is present outside the housing, that in a side wall of the first longitudinal rail assembly opposite the second longitudinal rail assembly a recess is formed and that the drive motor is in a driven connection through the recess with the parts of the drive mechanism disposed in the interior of the first longitudinal rail assembly.

40. Support apparatus as claimed in claim 39, wherein:

a) the output shaft of the drive motor or an end of the drive motor bearing the output shaft of the drive motor or a first gear element in a driven connection with the output shaft of the drive motor project through the recess and into the interior of the first longitudinal rail assembly, wherein a first drive element is provided, and the first drive element is in a driven connection with a second gear element present in the interior of the first longitudinal rail assembly.

41. Support apparatus as claimed in claim 37, wherein:

a) the drive motor is disposed substantially completely outside the first longitudinal rail.

42. Support apparatus as claimed in claim 40, wherein:

a) the first gear element is a worm of a worm gear assembly, the worm wheel of which is disposed in the interior of the first longitudinal rail assembly and constitutes the second gear element.

43. Support apparatus as claimed in claim 42, wherein:

a) the worm is substantially nonrotatably connected to the output shaft of the drive motor.

44. Support apparatus as claimed in claim 37, wherein:

a) the first longitudinal assembly includes a profile height, and in side view the drive motor is located substantially within the profile height of the first longitudinal assembly in such a manner that the drive motor is disposed in or on the first longitudinal rail assembly without projecting vertically above the profile height.

45. Support apparatus as claimed in claim 37, wherein:

a) the drive motor is disposed on a side of the first longitudinal rail assembly opposite the second longitudinal rail assembly in such a manner that the drive motor is disposed between the two longitudinal rail assemblies.

46. Support apparatus as claimed in claim 34, wherein:

a) a drive mechanism is provided which includes at least one drive motor; and b) at least one of the longitudinal rail assemblies includes at least one pivot shaft rotatably mounted therewith, which constitutes a drive component of the drive mechanism and is in an actuating connection with at least one part of the support apparatus to be adjusted.

47. Support apparatus as claimed in claim 46, wherein:

a) operatively connected with at least one of the longitudinal rail assemblies at least two pivot shafts are mounted, and are provided on different support elements for the adjustment thereof.

48. Support apparatus as claimed in claim 46, wherein:

a) in the assembled state of the support apparatus each of the pivot shafts is in an actuating connection with the attached support via a lever assembly.

49. Support apparatus as claimed in claim 48, wherein:

a) each lever assembly features at least a pivot lever, which is substantially nonrotatably connected to the attached pivot shaft.

50. Support apparatus as claimed in claim 49, wherein:

a) the pivot lever is fixedly connected to the respective pivot shaft.

51. Support apparatus as claimed in claim 46, wherein:

a) a transmission element is provided for transmitting a rotation of a first pivot shaft connected to the first longitudinal rail assembly to the a third pivot shaft connected to the second longitudinal rail assembly or for transmitting a rotation of a second pivot shaft connected to the first longitudinal rail assembly to a fourth pivot shaft connected to the second longitudinal rail assembly.

52. Support apparatus as claimed in claim 51, wherein:

a) the first and the third pivot shaft are connected to the same support to be adjusted.

53. Support apparatus as claimed in claim 51, wherein:

a) the second and the fourth pivot shaft are connected to the same support to be adjusted.

54. Support apparatus as claimed in claim 51, wherein:

a) the transmission element connects the first and the third pivot shaft or the second and fourth pivot shaft substantially nonrotatably to one another.

55. Support apparatus as claimed in claim 54, wherein:

a) the transmission element for creating a substantially nonrotatable connection between pivot shafts features at least a connecting shaft.

56. Support apparatus as claimed in claim 55, wherein:

a) the connecting shaft can be connected to the pivot shafts substantially nonrotatably circumferentially, yet loosely axially.

57. Support apparatus as claimed in claim 56, wherein:

a) the pivot shafts to be connected each features an axial recess with an noncircular cross section, and the axial ends of the connecting shafts each features a cross section that is complementary to the respective recess in such a manner that the ends of the connecting shaft circumferentially engage the recesses in the pivot shafts.

58. Support apparatus as claimed in claim 55, wherein:

a) the ends of the connecting shaft can be inserted loosely into the recesses in the pivot shafts.

59. Support apparatus as claimed in claim 58, wherein:

a) a stopping element is provided for limiting the axial insertion depth of the ends of the connecting shaft into the recesses in the pivot shafts.

60. Support apparatus as claimed in claim 59, wherein:

a) the stopping element is formed at least partly by an outer frame of the support device.

61. Support apparatus as claimed in claim 58, wherein:

a) a stop is provided on each of the pivot shafts connected substantially nonrotatably to one another through a connecting shaft.

* * * * *